United States Patent [19]

De Witt et al.

[11] Patent Number: 4,631,527

[45] Date of Patent: Dec. 23, 1986

[54] TRANSMITTER-RECEIVER CODED SECURITY ALARM SYSTEM

[75] Inventors: Kenneth I. De Witt, Phoenix; Michael L. Kovens, Randallstown, both of Md.

[73] Assignee: Universal Security Instruments, Inc., Owings Mills, Md.

[21] Appl. No.: 210,477

[22] Filed: Nov. 25, 1980

[51] Int. Cl.[4] ..... G08B 1/08

[52] U.S. Cl. ..... 340/539; 340/531; 340/534

[58] Field of Search ..... 340/539, 164 R, 636, 340/531, 506, 541, 527, 528, 514, 534, 825.69, 825.72, 825.45; 455/53; 179/5 R, 5 P

[56] References Cited

U.S. PATENT DOCUMENTS

| | | | |
|---|---|---|---|
| 3,808,534 | 4/1974 | Summers et al. | 340/636 |
| 3,833,895 | 9/1974 | Fecteau | 340/539 |
| 3,914,692 | 10/1975 | Seaborn | 340/539 |
| 3,925,763 | 12/1975 | Wadhwani et al. | 340/539 |
| 4,189,719 | 2/1980 | Massa et al. | 340/164 R |
| 4,189,720 | 2/1980 | Lott | 340/539 |
| 4,191,948 | 3/1980 | Stockdale | 340/539 |
| 4,257,038 | 3/1981 | Rounds et al. | 340/539 |

*Primary Examiner*—Donnie L. Crosland
*Attorney, Agent, or Firm*—Hall, Myers & Rose

[57] ABSTRACT

A transmit-receive burglar alarm system provides for code changing so that the user may readily change the transmitted code to which the system will respond. The transmitter is battery powered, and the transmission circuits are disabled except during transmission intervals to conserve battery life, the transmitter transmitting a weak battery signal when the battery voltage falls below a prescribed level, the receiver providing a distinctive signal in response thereto. The transmitter may select one of two channels at the receiver depending upon the desired response and may also select a delayed or immediate response if the receiver is in the delay mode. The home or base station includes a receiver and a microprocessor to determine first if the transmitted code is proper to respond to and then on which of two channels the response is to be indicated; the channels determining the format of the audio signal to be generated both on internal and external audio devices. The base station determines whether system response is to be immediate or whether the transmitter is to control response as either immediate or delayed. System, battery and indicator light tests are provided as are indications for loss of a.c. or low base station battery. Ability to change the disarm code is also provided together with means to cause the disarm code to revert to a factory disarm code if the changed code is forgotten or all power is lost.

24 Claims, 8 Drawing Figures

MATCH
BATT. RESET
BATT. TEST
SYST TEST
SET CODE
SET DELAY
3 15 SEC
6 30 SEC
9 45 SEC
LAMP TEST
SILENT
2 10 SEC
5 25 SEC
8 40 SEC
0
ARM DELAY
1 5 SEC
4 20 SEC
7 35 SEC
ALARM RESET
ARM
STATUS INDICATORS
74LS259
4069
U6
100K
10K
2.2K
33μf
.01μf
100Ω
+5
+5V
CH2
28
30
101
129
131
135
70
71
72
73
74
75

TRANSMITTER-RECEIVER CODED SECURITY ALARM SYSTEM

TECHNICAL BACKGROUND

The present invention relates to burglar alarm systems, and more particularly, to burglar alarm systems having remote transmitters and a receiver which responds to coded signals generated by the transmitters in response to unlawful entry of the premises or deliberate broadcast of a signal under specified circumstances.

BACKGROUND ART

There are numerous burglar alarm systems available today utilizing remote transmitters so as to avoid the necessity for carrying wires throughout the entire area to be protected. Normally, these transmitters are mounted on various closures and utilize, as does the present invention, magnets adjacent to a magnet sensing portion of the transmitter so that if the magnet is moved away from the transmitter, a signal can be generated to indicate opening of a closure. Such systems provide a predetermined length of time or delay between opening of a closure and the sounding of the alarm to permit an authorized individual to disarm the alarm circuit before it is activated.

The prior art systems suffer from several difficulties in that if the user forgets the disarm code, the system becomes useless to the individual and it must be returned to the manufacturer or the manufacturer's representative for code resetting. Another problem is that there are times when it is desired to be able to override a delay built in or keyed into the response circuit of the system and such systems do not permit such operation. Another difficulty with the prior art systems is that the transmitter batteries may become sufficiently weak and they will not operate the system, and even though the user believes the area is protected, there is, in fact no protection being provided at least from one station and perhaps more.

Still another difficulty of the prior art systems is the inability to change the transmit-receive codes. There is always the possibility that a neighbor could receive a unit from the factory having the same code as his neighbor's unit. The systems now available would require a return of one of the units to the factory to have the coding changed so that the neighbors do not interfere with one another.

BACKGROUND OF THE INVENTION

It is an object of the present invention to provide a burglar alarm system utilizing remote transmitters for transmitting alarm or other signals to a base station providing great flexibility in the selection of various modes of operation of the system.

It is another object of the present invention to provide a burglar alarm system having remote transmitters transmitting a coded frequency shift signal (FSK) to a central receiver wherein a remote transmitter transmits a weak battery signal to the central station whenever its battery voltage has fallen below a specified threshold. The transmitter thereafter shuts itself down while the base station continues to generate a specific sound over its internal speaker to indicate that one of the transmitters has a weak battery.

It is yet another object of the present invention to provide a remote transmitter-receiver base station burglar alarm system wherein the response to a transmission may be delayed to permit an authorized user to disarm the system before an alarm is sounded to which may be set to be activated immediately upon opening of a closure whereby delay may be provided on door entry detectors and no delay provided for window opening detectors.

It is still another object of the present invention to provide a remote transmitter-receiver base station burglar alarm system wherein no delay in response to receipt of entry signals may be programmed but wherein response of the system is delayed for a specified length of time after arming to permit an individual to leave the building without producing an alarm.

It is yet another object of the present invention to provide a transmitter-receiver base station combination for burglar alarm systems wherein the main receiver unit may be programmed to respond immediately to a remote signal or have a delayed response to a remote signal and wherein the remote transmitter may be programmed to produce an instantaneous response of the base station in spite of the fact that the base station is in the delay mode whereby such transmitter may be utilized by an invalid to call for help wituout a required delay interval between transmission of a panic call for help and response of the system. p It is still another object of the present invention to provide a transmit-receive combination for burglar alarm systems wherein if the disarm code has been forgotten, the system may be caused to revert to a factory preset code by disconnecting all power sources from the unit and then reestablishing power.

It is yet another object of the present invention to provide a transmitter-receiver combination for burglar alarm systems wherein the transmit-receive code is changeable by the user.

It is another object of the present invention to provide a remote transmitter-receiver burglar alarm system in which a volume control for the audio alarm is provided, but in which, in a panic mode of operation, full volume is generated.

Still another object of the present invention is to provide a remote transmitter-receiver burglar alarm system utilizing a transmitter for sensing the sound from a smoke detector to actuate burglar alarm sirens.

The present invention contemplates the use of frequency shift keying transmission in accordance with a predetermined code set into a transmitter for sending signals to a remote base station upon unauthorized entry into a house or upon closing of a switch by a user. The battery powered transmitter transmits, in accordance with the predetermined code, alternatively, two frequencies; for example, 2.3 KHz for a zero level and 2.9 KHz for a one level.

The transmitter includes a low voltage detector system which, when low voltage of its battery is detected, transmits a predetermined code to the receiver and then locks itself out so it is no longer operative until the weak battery is replaced. The transmitter, upon detecting a weak battery, transmits for only a very brief period before lock-out, and the receiver, upon receiving the information, provides a distinctive sound indicating a low voltage condition; the sound being continued until deliberately terminated by a knowledgeable operator. Since that particular transmitter can no longer operate, it can be readily segregated from the remainder of the units which are operable by simply testing each of the transmitters and finding which one does not produce a short test response at the central receiver upon actuation to establish a condition which would cause response of the receiver.

The code of the transmitter may be changed in conformity with changes in the code at the receiver and the transmitter may be provided with one or two transmission actuating means. In all transmitters, there is provided a reed switch which is intended to be operated by a magnet; the transmitter being disposed on one part of a relatively movable combination such as a door frame and window frame with a magnet mounted on the movable member. When the magnet is aligned with the switch, the switch is conditioned to produce no transmissions from the transmitter. When the magnet is moved from adjacent the transmitter, the transmitter is actuated and causes the receiver to produce a sound. To conserve battery life, voltage is maintained only on a small portion of the transmitter except during the transmission of a code at which time voltage is applied to the entire circuit. Only the sensing circuits are maintained active during standby condition; the code generating and transmission circuits being operable only when the reed switch or the other mechanism for producing the alarm is operated.

The other means for sending a signal from selected transmitters is a push button which, upon actuation, causes the receiver to sound an alarm.

The transmitter transmit 14 data bits per frame and transmits 10 frames in less that 1 second; this pattern being repeated every 30 seconds if the detected condition continues. The first four bits of each frame are always blank, i.e. zeros, for purposes which will become apparent when considering the detailed drawings. The four zeros are followed by a start bit which is always a 1 and then six code bits that must match the receiver code to produce a response. Also transmitted are a seventh code bit which determines whether a receiver will respond on its first or second channel, an eighth code bit which indicates that if the receiver is operating in the delay mode, the receiver should delay response to the transmission or should not delay response, and a ninth code bit; the fourteenth bit of transmission, which indicates that a low battery exists if a "one" is transmitted. If the transmitter does not indicate that the receiver should delay, then the receiver will respond immediately even though the receiver has been programmed for delay. Specifically, when the receiver has been programmed for delay, it will respond immediately if it does not receive a delay indicating bit from the transmitter and will respond with a delay when it receives a bit indicating that it should delay its response. If the receiver is in the non-delay mode, it will respond immediately regardless of transmission of the delay bit by the transmitter. The transmitters, for instance, associated with windows may be programmed for no delay and actuate on one of the channels. Door transmitters may be programmed for delay so that a disarm delay interval is provided upon entry, and response may be provided in either channel.

Referring now to the base unit, it will respond only to signals received in conjunction with a proper code. The base unit includes a microprocessor which, upon detecting a proper incoming code responds in accordance with a programmed response that the user has indicated should be provided. The base station has a regenerative receiver for simplicity and high gain. The signals are then presented to a decoder circuit which produces voltage levels which vary in response to the two different frequencies transmitted by the transmitter for data purposes. The signals received are provided to the microprocessor which, depending upon the nature of the signals, produces the programmed response. If the signal is to be processed in accordance with Channel 1, a local speaker is caused to produce one sound; for instance, alternating high-low frequencies. If Channel 2 is involved, then the speaker produces a different sound, for instance, an interrupted sound.

The base station is powered by both a.c. and a battery, so that if the a.c. is lost, the system will continue to operate. A low battery indication is also provided at the receiver to warn that the battery is weak. If the a.c. fails and the batteries are operative, the indicator lights at the base unit go into a blinking mode whereas a low battery in the base station produces a clicking sound in the base unit speaker when an appropriate test button is depressed.

The base station is also provided with switches to change the code to which it will respond, and it is provided with a keyboard which permits various different functions to be accomplished. The receiver permits the delayed time to be programmed over a wide selection of timing and also permits the entry code to be changed. If all power fails, the entry code reverts to a code built in at the factory. Thus, if the user forgets his personal code, all power may be terminated and the factory code, such as 1, 2, 3 is reinstituted.

In response to receipt of a code, the base unit, if the received code indicates a response on Channel 1, produces a high-low sound and the Channel 1 indicator light is turned on. When the alarm is disabled by time (10 minutes) or by keying in the proper code, the Channel 1 indicator light blinks to indicate that the channel had been activated. A response to a Channel 2 signal causes a high-off audio signal to be produced and the Channel 2 indicator light has the same operation as Channel 1. Channel 2 is also the panic channel.

If signals on both Channels 1 and 2 are received, the Channel 2 sound is produced on the internal speaker, or continuous high is produced on the external siren, and both indicator lights are illuminated. A volume control for the speakers is provided; however, if a panic switch is in the panic setting at the base station, receipt of a signal on Channel 2 only, causes the audio signal to be generated at maximum volume.

A keyboard also permits system and battery tests that sound only the internal speaker. All system functions are controlled from the keyboard except the transmitter receipt code and the panic control which are controlled by a separate set of switches.

The unit is also supplied with a fire alarm transmitter which employs a microphone and amplifier to provide a signal to the transmit section of the transmitter. The unit has appropriate time delay and threshold circuits so it will respond only to loud continuous signals of a smoke detector to trigger the base station alarms.

DETAILED DESCRIPTION OF THE PREFERRED EMBODIMENT

Figure 1:
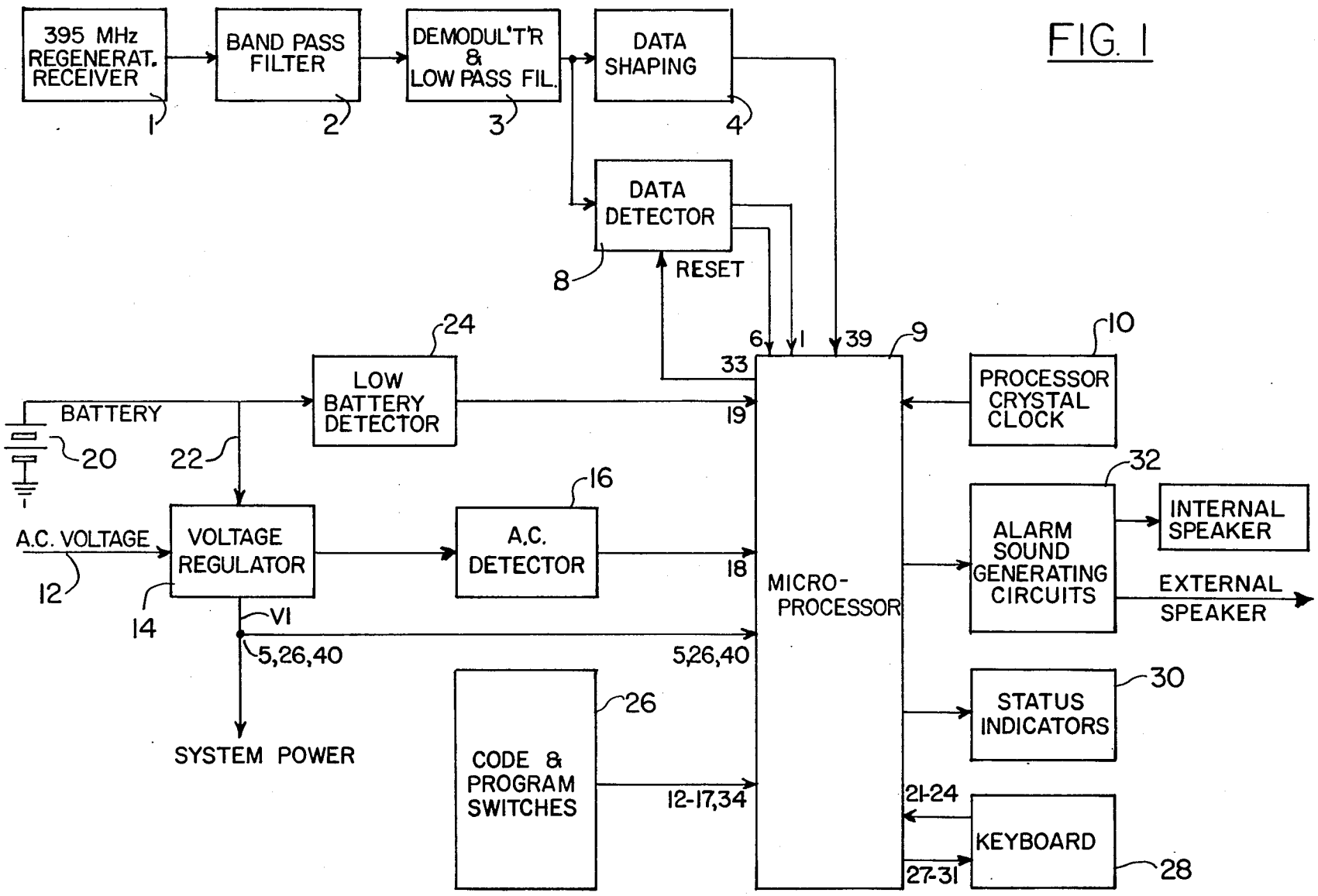
FIG. 1 is a block diagram of the receiver of the present invention.

Referring now to FIG. 1 of the accompanying drawings, there is illustrated a block diagram of the receiver and signal processing circuits, the microprocessor and control circuits of the base unit of the system of the present invention. The receiver comprises essentially a 395 MHz regenerative receiver designated by the reference numeral 1 for receiving a 395 MHz carrier, amplitude modulated with FSK signal at 2.3 KHz and 2.9 KHz at 100% modulation. The regenerative receiver is used to provide high gain with considerably simplicity and economy.

The output signals from the receiver 1 pass through a band pass filter, 2, to a demodulator and low pass filter, 3. The band pass filter is used to eliminate background noise. The FSK signal comprises essentially a constant 2.3 KHz signal which represents a "0" level and the 2.9 KHz signal which represent a "1" level in the code employed in the present invention. The FSK demodulator produces a high level signal during the periods when a 2.9 KHz signal is received and produces a low level signal whenever a "0" signal is received, i.e. a 2.3 KHz signal. The resultant signal is a pulse width modulated signal; the width of the positive excursions defining the receipt of a "1" or a "0."

The pulse width code is applied to a data shaping or slicer circut 4 which produces output pulses whenever the 2.9 KHz signal is received. The data information is applied via pin 39 to an 8049 microprocessor purchased, for instance, from National Semi-Conductor.

The output signal from the demodulator and low pass filter circuits, 3, is also fed to a data detector which supplied a signal to pins 1 and 6 of the 8049. The microprocessor operates on an interrupt basis and upon receipt of each bit of a data frame, a signal is applied to pin 1 of the microprocessor which looks to pin 6 for an interrupt signal. Upon receipt of the signal at pin 6, the microprocessor looks for data on pin 39 and operates on it whenever it is presented. In the intervals between receipt of a bit of data, the microprocessor performs functions such as scanning the keyboard or other parts of the system. To accomplish this latter feature, as soon as pin 6 goes low, it immediately strokes pin 33 of the microprocessor and resets the data detector so that only upon receipt of each bit of data, the microprocessor is placed in the interrupt mode.

The microprocessor is provided with a crystal controlled clock generally designated by reference numeral 10 for controlling all of its timing functions.

For reliability purposes, the receiver-microprocessor part of the system which is illustrated in FIG. 1, is provided with a battery backup to the a.c. voltage supply. A.C. is applied over a line 12 to a voltage regulator 14 that supplies power, hereinafter designated V1, to the system and to pins 5, 26 and 40 of the microprocessor. A signal is also supplied from the voltage regulator to an a.c. detector 16 which provides an a.c. power failure signal to the microprocessor 9 for purposes to be described subsequently. A backup battery is designated by reference numeral 20 and is applied via a lead 22 to the voltage regulator 14 whereby upon loss of a.c. power, the battery supplies power to the system. A low battery detector 24 is also provided and provides a signal to terminal 19 of the microprocessor also for purposes to be described subsequently. The system is also provided with a plurality of code and program switches 26 which are employed in the first instance to select the code which the system will respond to from a remote transmitter and the mode of operation of the system specifically on Channel 1 or Channel 2 and whether the system will operate with delay or without delay.

Control of the system, more particularly of its various functions, such as, the turn-off code, delay arm and test are all controlled from a keyboard 28 which is supplied sequential pulses from the microprocessor via pins 27–31 and which keyboard provides information to the micro-processor via pins 21–24. The functions of the keyboard are described in detail relative to FIG. 2, but basically constitute keys 1–9 for selecting one of various available time delay responses of the system so that the protected area may be entered by a resident or other knowledgeable person and the system turned off before the alarm takes effect. The keyboard also has buttons for conducting various tests of the system, such as testing battery indicator lights and overall system function and provides other control switches for changing the internal turn-off code, turnging off the internal speaker, resetting the alarm and arming the system for immediate response or arming the system for delayed response. The case of the apparatus also has a plurality, to be exact, 6 indicator lights, to provide status indicators generally designated in FIG. 1 by the reference numeral 30. The system is completed by the provision of alarm sounding circuits 32 for providing two different sounds of the alarm for first and second channels of the system, a sound for low battery indication and also to actuate an external speaker or siren, if so desired.

Reference is now made to FIG. 2 of the accompanying drawings which constitutes FIGS. 2A, 2B, 2C and 2D; assembled 2A and 2B horizontally, 2C and 2D horizontally below 2A and 2B, left to right.

Initially, the signal receiving circuits define thereafter the operation of the system in conjunction with the transmitters described. In FIG. 2, each of the major elements which are illustrated and described in FIG. 1, are enclosed within dashed-line boxes and designated by the same reference numerals as in FIG. 1. The receiver 1 constitutes, as indicated, a purely conventional regeneration receiver having a loop antenna designated by reference numeral 34.

The regenerative receiver receives the AM modulated 395 MHz signal and passes it through band pass filter 2 wherein background noise is reduced. The low pass filter utilizes four amplifiers, 36, 38, 40 and 42, which are the four amplifiers provided on standard chip #324.

The output signal from filter 2 is an FSK signal which is now applied to the demodulator and low pass filter circuit 3. The first element in this circuit is a Schmitt Trigger 44, employing one of four amplifiers on a chip Number 339. The Schmitt Trigger passes all signals above a predetermined threshold. This circuit amplifies and clips the signals above the threshold to square them up for processing by a dual edge one shot designated by the reference numeral 46.

The one-shot 46 produces a 100 per microsecond positive pulse at each transition of the squared input sine wave from low to high and high to low. The output pulses from the one-shot 46 are applied to low pass filter 48 which produces a d.c. signal that varies as a function of the incoming frequency. The nominal signal level at the output of filter 48 is, in the presence of incoming signals, approximately 2.5 volts. The signals vary about this level by approximately 0.6 V peak-to-peak and the input signals to clamp 50 are clamped at a maximum of 2.7 V; the clamping voltage appearing on pin 10 of the amplifier of the clamp, one amplifier of a chip #324. Amplifier 54, which also receives the output of the low pass filter, has a voltage of 2.6 V applied to its pin 4, to provide a slice voltage. The signal which now varies between 2.1 V and 2.7 V is greatly amplified by amplifier 54 to produce the pulse train of Waveform A of FIG. 3 of the accompanying drawings which appears on pin 39 of the microprocessor 39. The amplifiers 50 and 54 and associated circuits constitute the data shaper 4 of FIG. 1.

The microprocessor performs many functions related to the system and is sequenced by the oscillator 10; the frequency of which is controlled by the crystal 51 and associated circuits connected across pins 2, 3 and 4 of the microprocessor 9. The established frequency is 4.19 MHz.

The microprocessor interrogates each of its signal and control input and output pins on a periodic basis so as to perform various functions to be described. Upon receipt of incoming signals from a transmitter, an interrupt command is generated so that the processor will hold whatever it was doing at that time and go look for data on the pin 39. Actually the processor receives two signals at the time information is received. The first signal which is applied to pin 1 indicated that an interrupt signal may be coming and causes the precessor to look for it on pin 6 and upon receipt of the actual interrupt signal, the processor looks at the pin 39; 2.7M seconds later, the approximate center of the data portion of the pulse.

The aforesaid signals are generated by the data detector 8. A lead 55 receives signals from the low pass filter 48 and is connected to a capacitor 57 having one plate grounded via a diode 56. The capacitor 57 is charged through a resistor 59 when the diode 56 is blocked.

In the absence of an incoming signal, the lead 55 is at about ground level and the capacitor 57 is discharged. Upon receipt of a signal, 2,5 volts are established at the output of the filter 48, the diode 56 is blocked and the capacitor 57 is charged. A potential of 1 volt is applied to pin 7 of amplifier 58, one active element of a chip #339. When the voltage across capacitor rises above the voltage on pin 7, the output on pin 1 falls to zero or ground and is applied to pin 9 of a flip-flop 60. It is noted in FIG. 3, Waveform B, that the first quarter of every bit is positive and the resulting positive pulse at the output of amplifier 54 is applied to pin 11 of the flip-flop 60 setting it at the beginning of each bit of the incoming code. The signals appearing at the output of amplifier 58 is then passed to interrupt pin 6 of the microprocessor 6. The signal from amplifier 58 is also applied to pin 1 of the microprocessor 9 and arrives slightly before the signal on pin 6 due to delay through the flip-flop 60. As previously indicated, a signal on pin 1 of the processor alerts it to look for an interrupt signal on pin 6.

After the microprocessor has acknowledged the start of a data bit, a reset bit appears on pin 33 of the microprocessor 9 and is applied to pin 8 of the flip-flop 60 so that the microprocessor may perform other functions between receipt of bits. Also, the reinstitution of a signal, i.e. the pulsing of pin 6, at the beginning of each bit time starts the 2.7M sec. interval at the end of which the information on Pin 39 is to be sensed by the microprocessor; thus insuring sensing only of well-established pulses.

It should be noted briefly at this time that the incoming code must match the code that has been stored in the micro-processor as proper for response by the system. There may be another transmitter for identical apparatus in the neighborhood and the code for such transmitter should be different from the code on the particular unit under consideration. If the codes are the same, this will become apparent, and the code on one of the systems can be changed on both the transmitters and the base stations as will be indicated in detail subsequently. Codes which are not proper will not be responded to by the microprocessor. Those which are proper will produce the desired response.

The entry of information from the keyboard is considered next. It should be pointed out that all terminals on the microprocessor are scanned at a rate determined by the crystal oscillator 10 which operates at a frequency of 4.19 MHz. Each of the leads is sequentially and repetitively interrogated except, of course, in the presence of an interrupt signal. Referring now specifically to the operation of the keyboard, pins 27–31 (during keyboard entry) receive pulses at regular intervals and transmit them to the keyboard. In order to produce a signal on lead 2 at the time that a signal appears on the pin 27 of the microprocessor, the button marked "1" must be depressed. In order to produce a signal on leads 22, 23 or 24 at the time a signal is applied to pin 27, the buttons marked 2, 3 and Battery Reset must be depressed respectively. Similarly, in order to produce a signal on the leads 21–24 at the time a pulse appears on the pin 28 of the microprocessor switch 4, 5, 6 or Battery Test respectively must be depressed and so on. Thus, the keyboard 28 operates on a time-position matrix. The program for the microprocessor, set forth hereafter, provides a preprogrammed factory set disarm code which, for purposes of example, is 1, 2, 3 in that order. Thus, if an alarm is ringing, it is necessary to press the buttons, 1, 2, 3 in order to terminate the audible alarm. This code can be changed and is done so by pressing the set code button, inserting the preset code which in this instance is 1, 2, 3 and then keying in a new code which may be any sequence of any three buttons on the keyboard. Thus, the code could be Battery Reset, Battery Test, and System Test in any order. Thereafter, whenever the alarm sounds for any reason, those three buttons must be pressed in the prescribed order to turn off the alarm. It should be noted that, if for any reason the system fails, i.e. if both the a.c. input and the battery are disconnected at the same time so that the system is totally inoperative, the microprocessor will automatically reset itself to the factory code of 1, 2, 3. This has the advantage that the system cannot become inoperative by inability to disarm due to the fact that perhaps power has gone off and come back up or the operator has forgotten the code. If the code is forgotten, the unit is disconnected from the a.c., the battery is disconnected and then the system will again respond to the factory code.

When the system is turned on, the standby light designated by the reference numeral 70 is illuminated. Whenever an instruction is given to the apparatus, the receipt and/or acknowledgement of the instruction is indicated by all six of the lights: the Alarm 1, LED71; Alarm 2, LED72; Standby, LED70; Silent, LED73; Arm, LED74; and Arm Delay, LED75 lights are lit momentarily. The Battery Test button is utilized to test the condition of the battery in the receiver of the base station. If the battery is low when the battery test button is pressed, there will be a single clicking sound. Of course, the same indication would be produced if no battery were present. After a Battery Test is made, the Battery Reset button is pressed. The system can be tested by pressing the System Test button, in which case the Arm light comes on. By keying in the disarm code, all lights light momentarily and then all go off indicating proper operation.

The Entry Delay is also a selectable feature of the invention. To set the Delay, and Set Delay button is pressed which now causes the Arm Delay light to be lit, and then the desired delayed time is set. If the delay time on entry, that is the delay between entry and disarming the unit, is to be thirty-five seconds, then the button 7 is pressed. On pressing the button six, all six lights of the display will light if the apparatus has received this information. In order to arm the device, the Arm or the Arm Delay buttons are pressed, one or the other, respectively. If it is desired to have an immediate response to a signal condition, then the Arm button is depressed. If it is wished to have a delay, then the Arm Delay is depressed.

When the alarm sounds, as previously indicated, it may be turned off by keying in the prescribed code. However, the alarm light associated with the channel that is actuated remains blinking so as to indicate which channel, and therefore, perhaps which exits have been intruded upon. The blinking light is removed by pressing the Alarm Reset button. The Lamp Test button is used to test the lights. The Silent button is used to turn off the internal speaker. The system, as may be seen from FIG. 1, has an internal and provision for an external speaker. If no one is home, it is well to turn off the internal speaker so that the base station is difficult to locate while the outside siren blares to provide an indication to the neighbors or passers-by that the house has been entered. It is obvious that if the in-house alarm were sounding, since it forms a part of the control box, it would be a simple matter to locate the source of the sound and pull the a.c. plug. This will not stop operation of the unit, however, since the battery will continue to operate. The battery must also be disconnected to terminate the alarm.

Figure 2A:
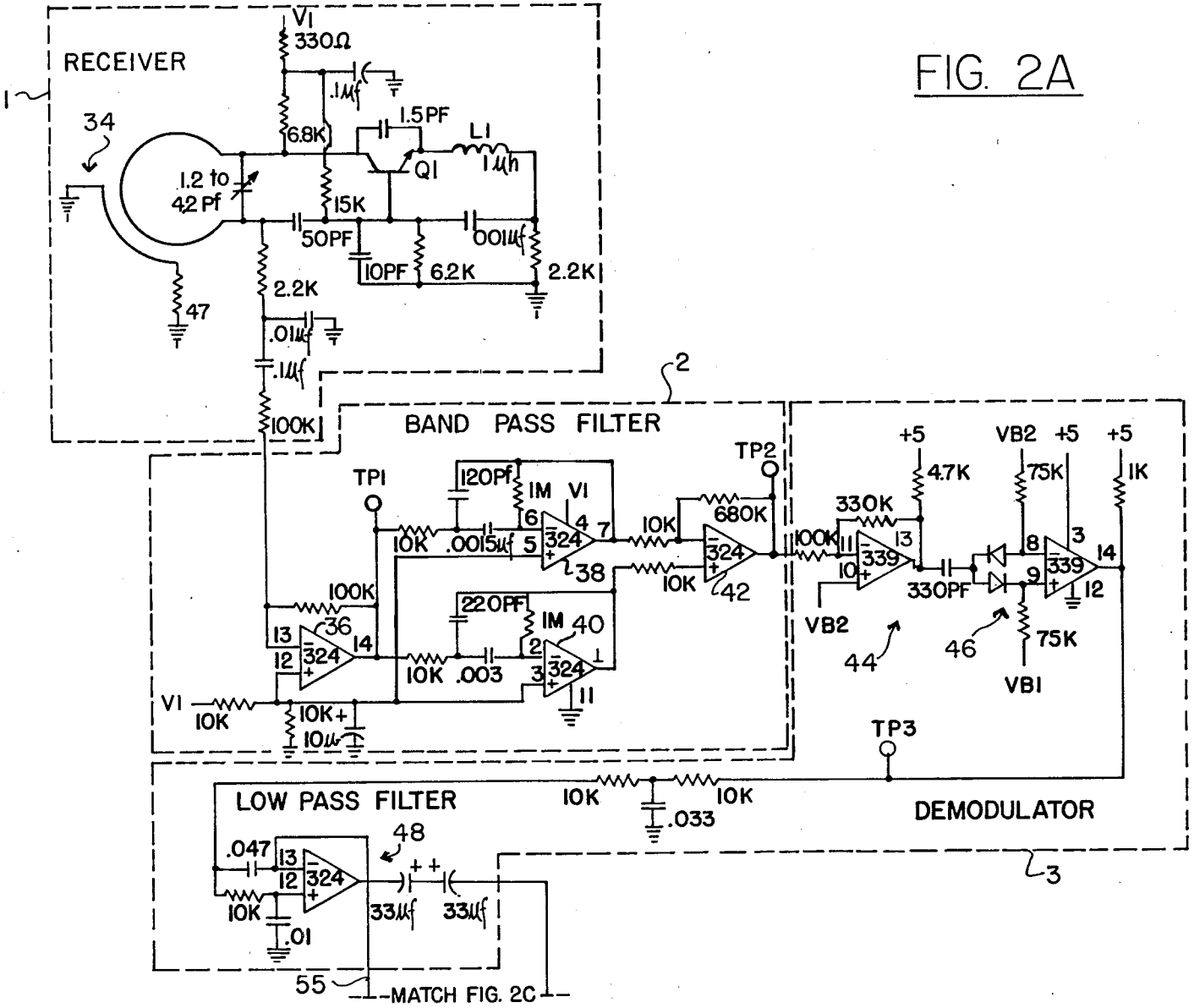
FIG. 2 comprising FIGS. 2A, 2B, 2C and 2D, constitutes a block diagram of the receiver of the present invention.
Figure 2B:
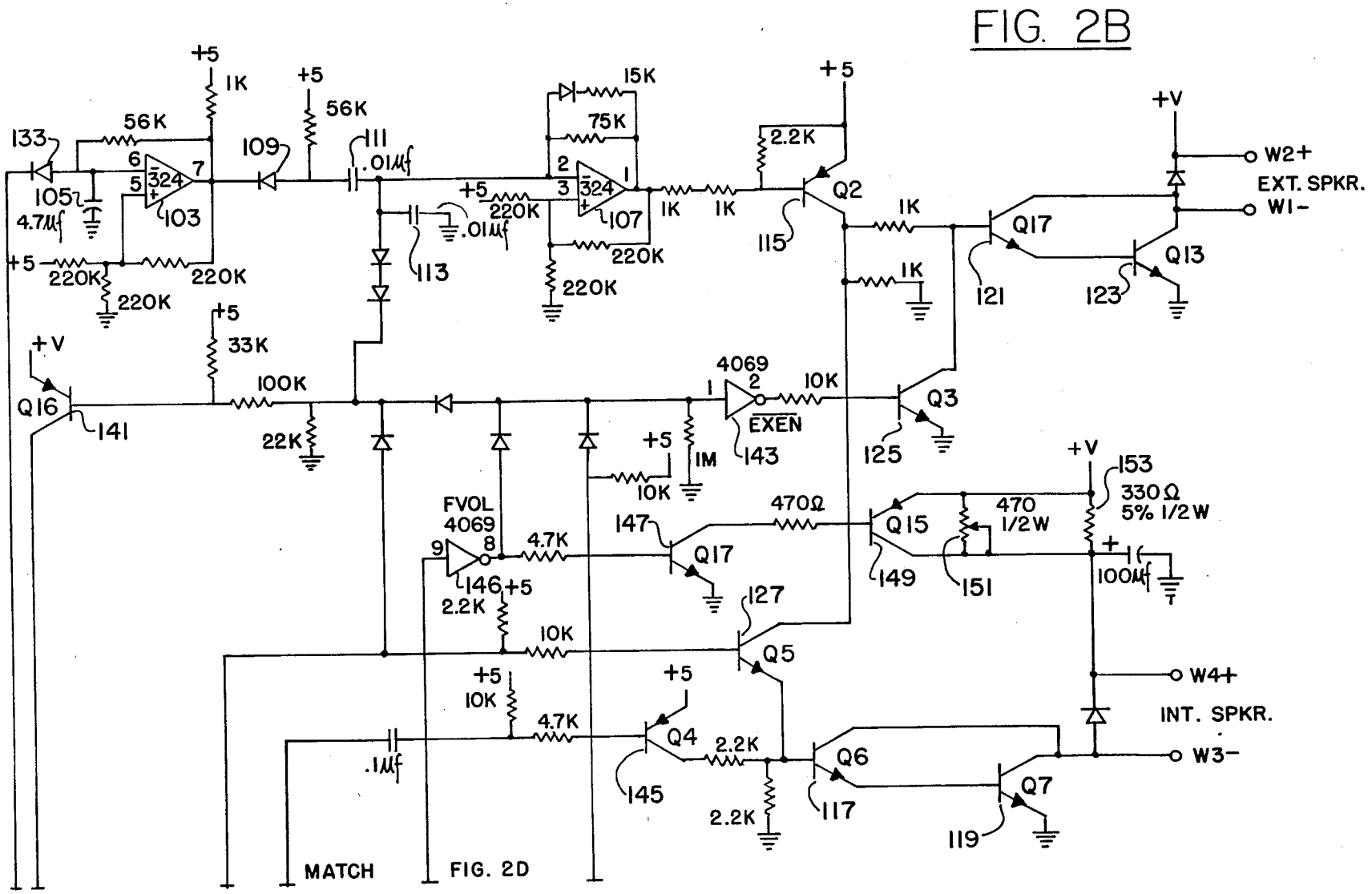
Figure 2C:
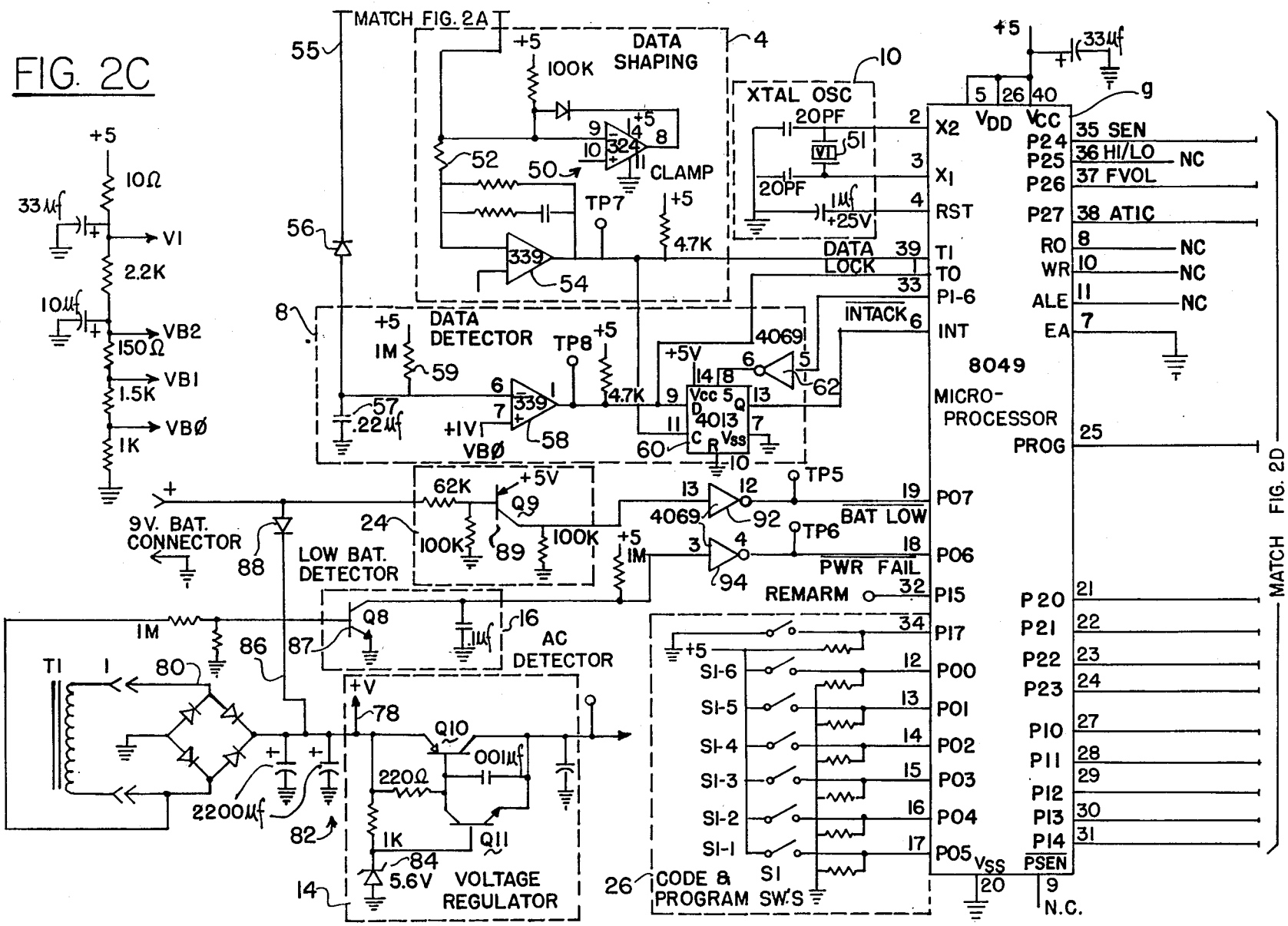
Figures 2B, 2D:
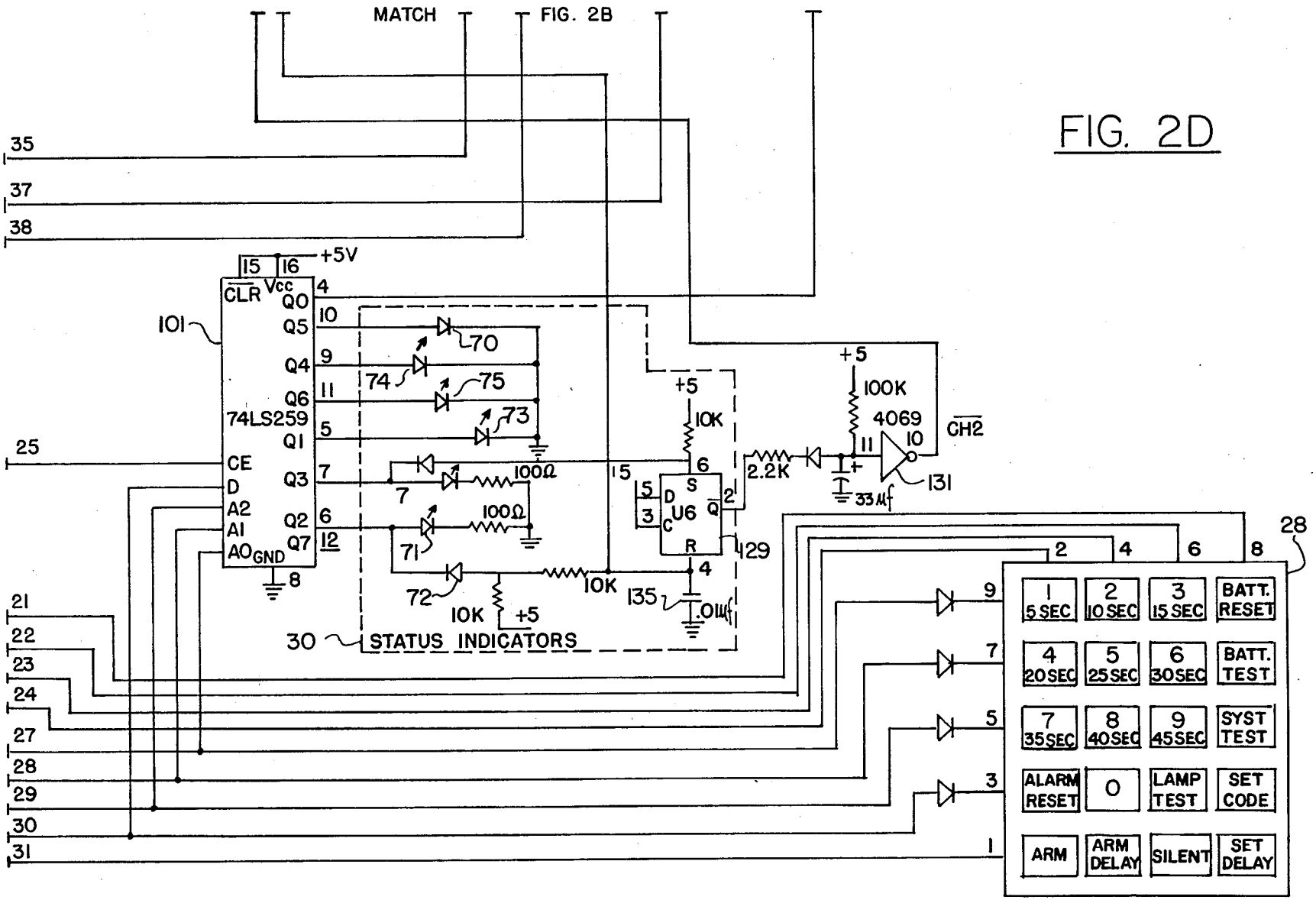

The power failure and low battery detectors comprise the elements 16 and 24 of FIG. 1 and appear in FIG. 2C in the schematic diagram. The voltage regulator 14 includes a full wave bridge rectifier 80, output filter 82 and a voltage regulator comprising transistors Q10 and Q11, Zener diode 84 and associated circuitry utilized to produce highly regulated positive 5 V output. A 9 V output appears on the terminal 78 and is utilized throughout the circuit where the V+ sign appears in the drawings. The output from the full wave bridge rectifier appears on a lead 86 connected to the base of transistor 87. The lead is also connected through diode 88 to lead 90 to which the positive terminal of the 9 V battery is connected. The diode 88 blocks the battery voltage from the d.c. circuit when the a.c. circuit is operative; the battery feeding the system when the a.c. circuit fails. If the voltage on the lead 90 falls below a certain threshold, the voltage on the collector of transistor 89 rises to a 5 V threshold and invertor 92 applies a low signal to pin 19 of the microprocessor which interprets this as a low battery. Thereafter, if the Battery Test button is pressed, a clicking sound is heard from the internal speaker of the system so long as the button is depressed.

If the a.c. fails, the base of transistor 87 goes to ground and the signal to inverter 94 rises and a power failure signal is applied to pin 18 of the microprocessor.

Reference is now made to the coding switches 26. By closing any one of switches S1-1 through S1-6, a specific six bit code is selected, this being the code to which the microprocessor will respond. The actual location of these switches is inside of the battery case on the main unit, and they are accessible only if the battery is removed, so that only knowledgeable persons know how to change the code. As previously indicated, if the incoming code does not match the codes set in by the switches, then the microprocessor does not respond to the received signals. A seventh switch, S1-7, may be employed for a so-called panic alarm condition. If the switch, S1-7, is closed, the panic is off. If it is open, a positive voltage is applied to pin 34 and the panic alarm is rendered operative. Under these circumstances, a transmission on Channel 2 causes instantaneous response to transmission even though the system is not armed and the audio signals are generated at maximum volume regardless of the normal volume setting. Also, the sound on both speakers is continuous. Such a unit may be used by invalids who can press a button and immediately sound an alarm to indicate that they are in extremis. If the switch is closed, pin 34 is grounded and the panic condition does not exist, and Channel 2 may be used for any purpose such as for windows, while Channel 1 is used for doors; the sounding of the alarm being different in response to the two channels as will be indicated subsequently.

As previously indicated, the base station provides both visual and audible signals. Table I below indicates the audible alarms produced in response to each condition.

TABLE I

| SPEAKER | Chan. 1 | Chan. 2 | Chan. 1 & 2 | Panic | System Test | Bat Low |
|---|---|---|---|---|---|---|
| Internal | Controlled Vol. Hi-Lo | Controlled Vol. Hi-Off | Controlled Vol. Hi-Off | Hi, Full Vol. | Chan. 1, Hi-Lo, 2.5 sec. Chan. 2, Hi-Off, 2.5 sec. | TIC |
| External Full Vol. | Hi-Lo | Hi | Hi | Hi | OFF | OFF |

The audio and visual alarms are controlled from Pins 25, 27–30, 35, 37 and 38 of the microprocessor 9 and Pins 4–7 and 9–11 of a 74LS259 chip 101 available from Texas Instruments. The element 101 receives on its Pins 1, 2, 3, 13 and 14, input signals from microprocessor Pins 27–30 and 25, respectively.

The truth table for operation of the indicator lights is as follows:

TABLE II

| 74LS259 | A0 | A1 | A2 | D | CE | FUNCTION |
|---|---|---|---|---|---|---|
| Q0 | L | L | L | F | L | External Disable |
| Q1 | H | L | L | U | L | Silent |
| Q2 | L | H | L | N | L | Alarm 1 |
| Q3 | H | H | L | C | L | Alarm 2 |
| Q4 | L | L | H | T | L | Arm |
| Q5 | H | L | H | I | L | Standby |
| Q6 | L | H | H | O | L | Arm Delay |
| Q7 | H | H | H | N | L | — |

Nothing changes at the output of element 101 until the CE signal goes low at which time the function on D(Pin 13) appears on the appropriate, i.e. selected pin. A high (+) signal produces a high and a zero produces a low. A high signal, energizes the lights.

The operation of the audible signals is controlled by the elements within the dashed box 32. Amplifier 103 is employed as an oscillator to control the high-low switching interval of the Channel 1 alarm. Timing is controlled by capacitor 105 and the switching rate is approximately 3 to 4 times per second; sounding intervals of 300M. secs.

Amplifier 105 is an audio oscillator and utilizes one of the amplifiers of the LM324 chip of amplifier 103. Hi-low oscillation is controlled by diode 109 which switches capacitor 111 in and out of the oscillator timing circuit including also capacitor 113. Transistor amplifier 115 couples the hi-low signal to the internal speaker audio driver consisting of transistors 117 and 119 and to external siren driver, transistors 121 and 123. Transistor 125 disables the external speaker described by grounding the base of transistor 121.

The sound for Channel 2 is determined by the signal on pin 35 of the microprocessor and pins 6 and 7 of the logic element 101. Transistor 127 is pulsed periodically to bias transistor 117 off, and concurrently, the $\overline{Q}$ output at pin 2 of flip-flop 129 is grounded to short capacitor 105 to ground and prevent oscillation of the oscillator including transistor 103. Thus a hi-off sound is generated on the internal speaker.

The flip-flop 129 receives inputs from pins 6 and 7 of the microprocessor 9 and determines whether the system produces a Channel 1 or Channel 2 response. Since the reset on the flip-flop takes precedence over signals on other inputs, when a high signal is applied to the reset pin 4 of the flip-flop, a positive signal appears on pin 2($\overline{Q}$), is inverted by invertor 131, grounds the capacitor 103 and stops the oscillator. If a signal appears only on pin 7(Q3) of the logic element 101, a positive signal appears at the output of invertor 131, diode 133 is blocked and the oscillator is operative.

Reference is made to transistor 141. When no sound is generated, the transistor 141 is conducting and when a sound is generated, the transistor is non-conducting. When the transistor 141 is conducting, it charges capacitor 135 and the flip-flop 129 is placed in condition for Channel 2 operation. This approach is employed to insure a clean sound on start of an audio cycle by insuring that the flip-flop 129 has a specific setting. When a sound is to be generated, the transistor 141 is turned off and the capacitor is controlled from pins 6 and 7 of the microprocessor which now assumes control of the flip-flop 129 before a "low" or "off" interval is to be instituted.

A voltage is also applied to the invertor 143 from pin 4 of the logic element 101 whenever a system test is to be conducted to disable the external speaker during such test periods. The low battery voltage signal is a series of short pulses which are developed on pin 38 of the microprocessor and are applied directly to the base of a transistor 145 which pulses the transistor 117 to produce a repetitive tic on the internal speaker only.

The panic signal which causes full volume to be developed on the internal speaker is applied from pin 37 of the microprocessor via invertor 146 to the base of transistor 147, the collector of which is connected to the base of transistor 149; having a variable resistor 151 connected beetween its emitter and collector. Resistor 151 controls the volume of the internal speaker and when a ground signal appears at pin 37 of the microprocessor, the transistor 149 is rendered conductive and shorts the resistors 151 and 153, applying full voltage to the transistor 119 and producing full volume.

Figure 3:
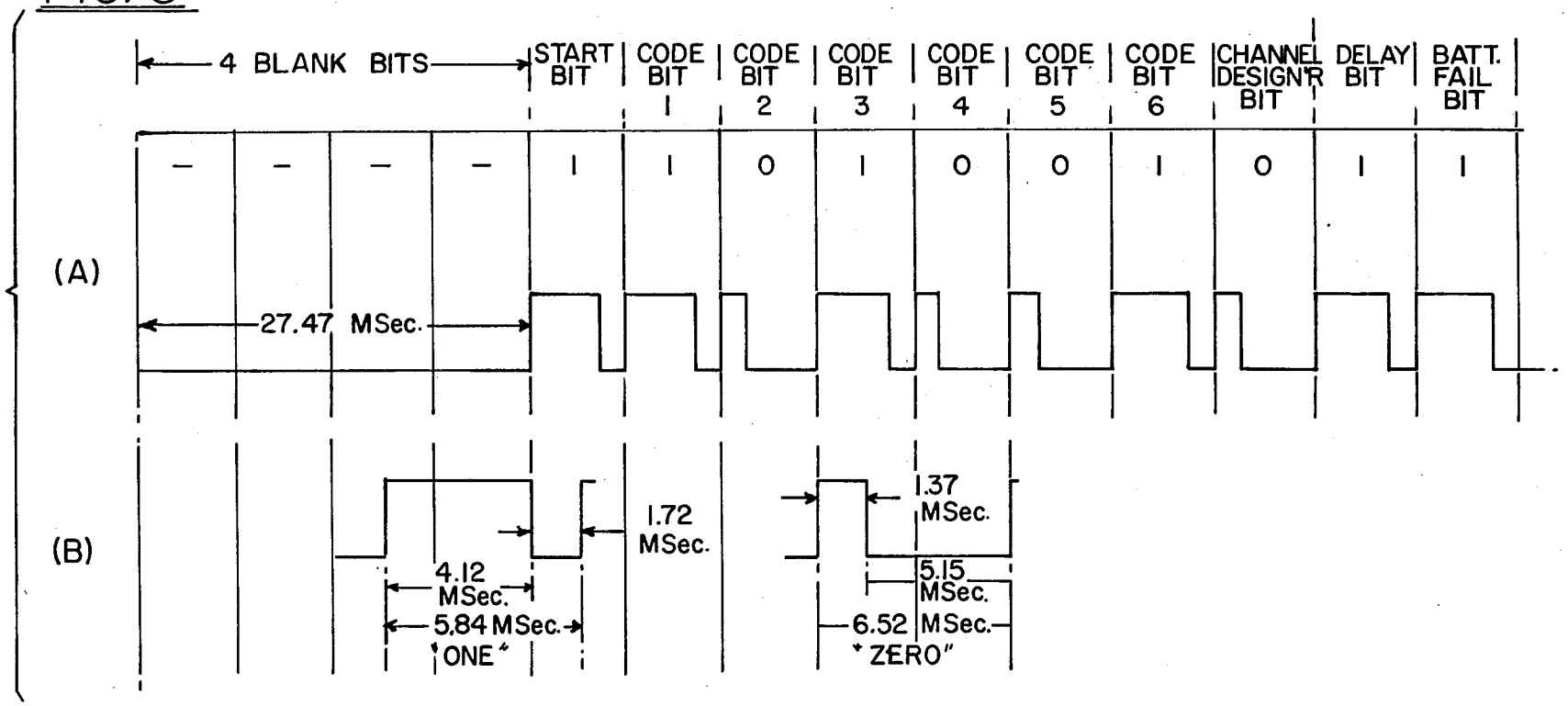
FIG. 3 illustrates the wave forms transmitted by the transmitter in Waveform A and in Waveform B illustrates the configuration and/or timing for each of a 1 and a 0 transmission.

Referring now specifically to FIG. 3, the format of the signals transmitted by any one of the remote transmitters is illustrated in Waveform A. An analysis of the individual "one" and "zero" data signals is seen in Waveform B of the Figure. A "one" is generated at the receiver in response to a 2.9 KHz signal transmission, the period being 4.2M sec. followed by a 2.3 KHz transmission producing at the input to the microprocessor a 1.72M secs. response for an elapsed time for a "1" of 5.82M secs. A "zero" is a 1.37M secs. pulse at the input to the microprocessor produced by transmission at 2.9 KHz followed by a transmission at 2.3 Khz producing a sequence of 5.15M secs. for a total elapsed time of 6.52M secs. for a "zero." Thus, the reception time of a given code varies with the code being transmitted and is thus asynchronous. This fact is one of the reasons for the bit detection circuit in the receiving apparatus. These times may vary proportionally±20% resultant normal operation of the system.

The format of the total code, and reference is made to Waveform A of FIG. 3, constitutes a transmission for 27.47M secs. or 4 bit times of the 2.3 KHz frequency followed always by a start bit which is a "1." The first four bits establish the 2.5 V level at the output of the low pass filter 48. The next six bits are code bits which, in order to operate a given microprocessor, must match the code inserted by switches S11 through S16 of the receiver. The seventh bit is the channel designation bit which may be a "1" or "0"; zero indicating an alarm on Channel 1 and a "1" indicating an alarm to be sounded on Channel 2. The sounds emitted by the speakers for the two channels are different, but the speakers are the same. The thirteenth code bit is the bit that determines whether the microprocessor produces an immediate audio response to a transmission from a given transmitter, or operates on delay if the Delay Arm circuit has been activated. If the Arm circuit is activated, whether the Delay Bit is transmitted or not, the base station will not delay its response. An important feature of the present invention is that the delay results from operation at the base station, not at the transmitter. The transmitter transmits immediately, and if the delay bit is transmitted and an Arm Delay condition exists at the receiver, then there will be a delay, but the signal is transmitted and received and interpreted immediately; the delay in response being programmed into the microprocessor. The fourteenth bit transmitted is the battery failure bit. The bit is a "1" when the battery is weak. The transmitter immediately shuts down after transmitting that bit. Again, the signal, upon reception by the microprocessor, places the microprocessor into the battery failure mode and institutes a clicking sound in the speaker which stays on until positively turned off. The transmitter transmits the weak battery code only through one transmission burst of ten frames and then the transmitter is turned off and cannot be actuated until the battery is replaced.

Figure 4:
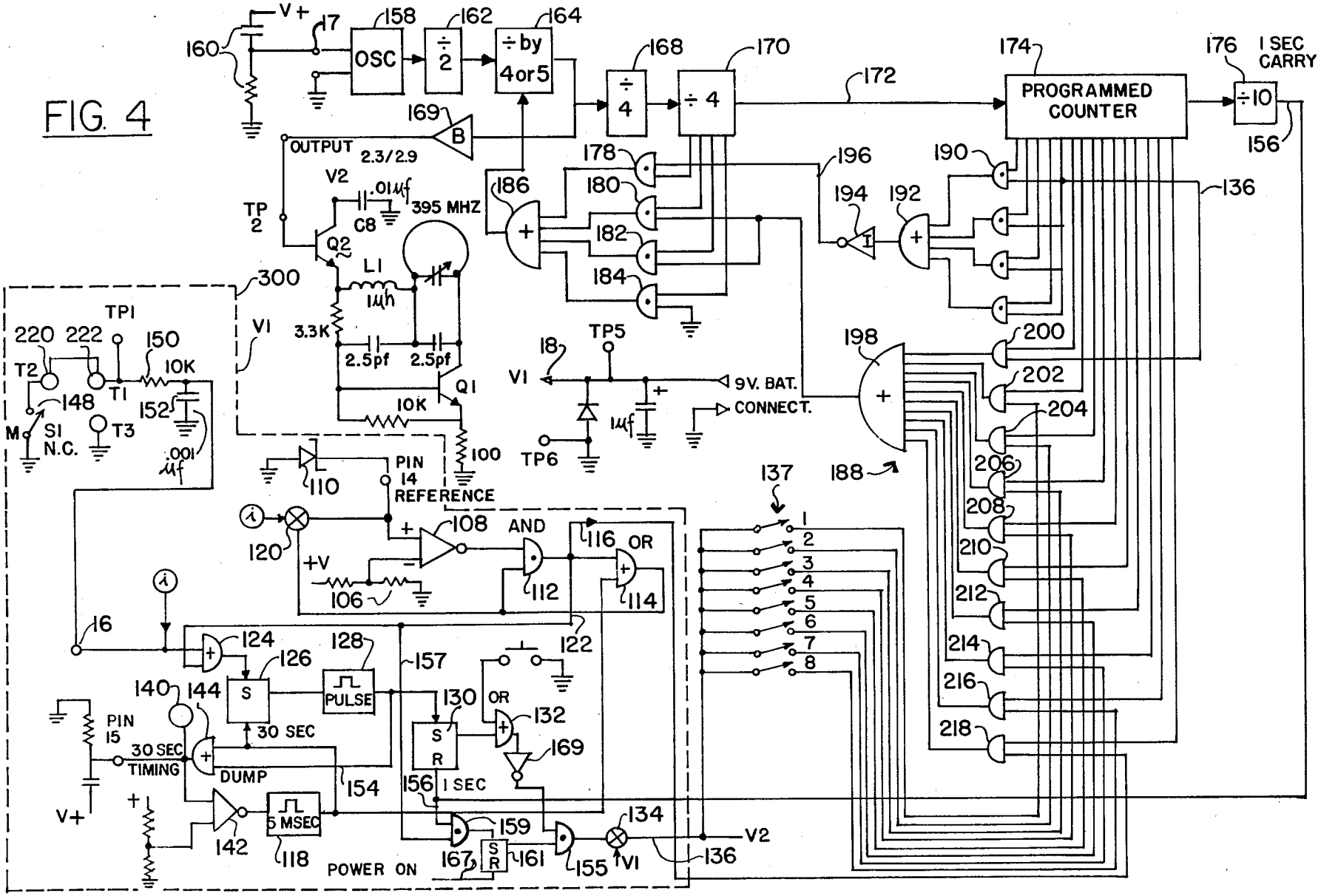
FiG. 4 is a combined block and circuit diagram of the transmitter of the present invention.

Referring now specifically to FIG. 4 of the accompanying drawing, the transmitter oscillator is a 395 MHz oscillator of conventional design and is generally designated by the reference numeral 100. Input signals or modulating signals to the oscillator are supplied via a lead 102 from the output section of the data generating section of the apparatus which is discussed subsequently.

Attention is directed to the dashed line 300 in FIG. 4. All elements within the line are always energized. All other elements are energized (Voltage $V_2$) only when switch 134 is closed.

Reference is now made to the low battery detector generally designated by the reference numeral 104. Battery voltage is applied across a resistor 106 connected to the negative terminal of a comparator invertor 108. A reference voltage, which is essentially derived from a Zener Diode 110, is connected to the positive terminal of the comparator invertor 108. The output of the comparator invertor 108 is applied to an AND gate 112; the output of which is applied as one input to an OR gate 114 and which is concurrently applied to a low battery indicator lead 116 discussed subsequently.

The operation of detector 104 is as follows: A 5M sec. pulse is derived from a pulse generator 118 and is applied as an input to OR gate 114. The output of OR gate 114 is applied as an input to AND gate 112 and as an input to a current switch 120. At each pulse of the source 118, the switch 120 is closed. Current flows through the Zener Diode 110 and a reference voltage is applied to the positive input of the comparator invertor 108. If the voltage of the battery is proper, that is at 9 V or 80% thereof, there is no output from the invertor, no signal is passed through the OR gate, and in consequence, no signal is developed on the low battery output 116. If, however, the voltage is low, a positive pulse is applied to the AND gate 112 from the comparator invertor 108 and a signal appears on the lead 116, and the circuit locks up. Specifically, the positive output at the output of the AND gate 112 produces a positive output at the OR gate 114 which is fed back to the second input to the AND gate and as long as the battery is low, the AND gate 112 and OR gate 114 lock up to produce a constant low battery voltage signal. The signal, as indicated, appears on a lead 116 and by means to be described subsequently, the signal is transmitted once and then the transmitter shuts down.

The signal on lead 122 is applied via OR gate 124 to flip-flop 126 to set the flip-flop and provide a high voltage to pulse source 128. The pulse causes flip-flop 130 to provide a low voltage to OR gate 132 which provides, via invertor, one input to AND gate 155.

The low battery signal on lead 122 is applied via lead 157 to AND gate 159 which receives a pulse every one second after actuation of the transmitter. The AND gate 159 drives a flip-flop 161 which is reset whenever power is turned on via lead 163. The flip-flop 161 supplies a second input to AND gate 155, the output of which is supplied to voltage switch 134.

In operation AND gate 155 is normally supplied with a high voltage from the flip-flop 161 so that when a high voltage is applied via invertor 169, a signal is applied to switch 134 and voltage is applied to lead 136 which supplies voltage $V_2$ to the transmitter and signal processing circuits. A low voltage signal appears on lead 116 and is transmitted to the base station. At the end of approximately one second, a signal is applied to the lower input, as viewed in FIG. 4, of AND gate 159 which, in conjunction with the signal on lead 157, causes a pulse to be applied to flip-flop 161 disabling AND gate 155 and preventing further transmission until the battery is removed and a new battery inserted which produces the power on pulse to set the flip-flop 161.

As previously indicated, the generator 118 produces a 5M sec. pulse every thirty seconds. The thirty second timing is achieved by capacitor resistor circuit generally designated by reference numeral 138 connected to a current source 140. The source is also applied to negative input of a comparator invertor 142 which drives the 5M sec. pulse generator 118. Basically, the circuit is an RC timing circuit with positive voltage applied to one end of the capacitor and a dump signal being derived from the output of the generator 118 via OR gate 144. Each time the OR gate 144 passes a pulse, the capacitor is dumped and restarts its timing cycle. The output of the generator 118 is also applied to the reset input of the flip-flop 126. The flip-flop is reset every thirty seconds so that the $V_2$ voltage is produced and the transmitter is energized every thirty seconds for one second only as required.

The main purpose of the thirty second timer is to permit transmission of signals from the transmitter every thirty seconds when a condition is to be transmitted from the transmitter other than low battery. By means to be described, a burst of ten frames is sent, the transmitter is then shut down for thirty seconds, and is again energized for a ten frame interval which is slightly under one second; the total elapsed time depending upon the number of 1's and 0's transmitted. If all 0's were transmitted, the elapsed time would be approximately 927M secs. which is less than one second. The normal mixture of 1's and 0's assures less than 1 second transmission in compliance with FCC regulations.

There are, in addition to the low battery signal source, two sources of transmission possible with a transmitter, although only one source is necessary for door and window closures. One source may be a push button 146 which is connected as a second input to OR gate 132 and another input or reed switch 148 is connected as a second input to OR gate 124. If manual operation is not to be provided and the unit is only expected to be responsive to opening or closing of a window or door or the like, the push button 146 is eliminated and only the reed switch 144 retained.

The normally closed reed switch 148 is operated by a magnet which is mounted immediately adjacent reed switch 148. The magnet is mounted, for instance, on a door or window and the transmitter is mounted on the window or door frame or vice versa. When the door or window is closed so that the magnet is immediately adjacent the switch 148, the switch is closed and the second input to the OR gate 124 is connected to ground through resistor 150. No signal is passed by the OR gate 124. Whenever the closure, the door or the window, is opened, the switch 148 opens. Capacitor 152 is fully charged and a signal is passed through the OR gate 124 to the flip-flop 126. The flip-flop 126 produces an output signal which causes the generator 128 to produce a pulse that sets the flip-flop 130 and lowers the voltage on its output lead which is applied through OR gate 132 to AND gate 155 via invertor 169. The switch 134 closes and applies power to the unit so that transmission can occur as described subsequently. It will be noted that the output of pulse generator 128 is also applied via a lead 154 to OR gate 144 which dumps the capacitor in the timing circuit 138 and starts the thirty second timing cycle. The flip-flop maintains power to switch 134 until it is reset approximately one second later via lead 100 by means to be described subsequently.

If the transmitter has a push button switch such as 146 for remote operation, closure of the switch 146 grounds the second input to OR gate 132 causing the voltage applied to the switch 134 to go low and the switch 134 to close and supply power to the lead 136 thereby causing a signal to be generated. It will be noted the signal produced by the reed switch 148 is turned off at the end of every one second interval whereas the signal that is generated by the push button 146 is not, since the output of the OR gate is not applied to the lead 154 which restarts the timing cycle for switching off the flip-flop 126. The reason for this is that an individual is controlling the situation, and he may wish to transmit at more frequent intervals than 30 seconds and for longer than one second to assure reception. In the case of the reed switch 148, when a window has been forced, that switch stays closed for an indefinite period, and transmission occurs every 30 seconds as required by FCC.

With voltage applied to the lead 136, voltage is applied to the control switches 1 through 8 of the code generating switches 137 of the system; the switches 137 designated 1 through 6 illustrated in FIG. 3. Switch 7 produces the channel designating bit, i.e. which channel will be activated in the receiver upon receipt of this code, and the 8th switch controls the delay bit to control whether it is wished to have the receiver respond immediately or only after delay, of course, again depending on the mode of operation programmed at the receiver; that is, armed or armed delay. Specifically, if the receiver is in an armed situation, the system will ignore the delay bit from the transmitter if it is transmitted and produces an immediate response. On the other hand, if the receiver is in a delay mode and the delay bit is not transmitted, the receiver will respond immediately. The only circumstances under which there will be a delay response is when the delay bit is transmitted by the transmitter, and the Delay Arm operation has been programmed into the microprocessor. Under these circumstances, a delay is instituted on entry.

Proceeding now with the description of the actual transmission of signals, an oscillator 158 has its frequency controlled by a timing circuit designated by the numeral 160. The oscillator is designed to operate at approximately 23.3 KHz, and the output of it is connected through a divide-by-two circuit 162; the output of which is directed to a divide-by-four or a divide-by-five circuit 164. This circuit is a counter which, when a signal is applied via a lead 166, divides by either four or five depending upon the nature of the signal on lead 166, the signal connecting to control circuitry controlling the routing of the counting pulses so as to provide the appropriate division.

The output signal from the circuit 164 is provided to a further divide-by-four circuit 168 and also to an amplifier 169 which provides a signal via lead 102 to transmitter 100 to be broadcast to the receiver. The divide-by-four circuit 168 provides an output signal to a further divide-by-four circuit 170, one output of which appears on a lead 172, now having a pulse rate thereon of 146 or 182 depending upon whether the division was by five or by four, respectively. The signal applied to the amplifier 169 is 2.3 KHz if the division is by five and 2.9 KHz if the division is by four. Thus, the signal on the lead 166 is controlling the frequency shift signal for transmission.

Referring again to lead 172, it is connected to a program counter 174 which divides by 14 and has 14 output leads. These leads are sequentially and successively pulsed and are designated 1 through 14 corresponding to the fourteen bit spaces in the output signal as illustrated in FIG. 3. The program counter also has a lead to a divide-by-ten circuit 176, the output of which provides a pulse on lead 156 slightly under one second after initiation of the counting cycle; i.e. after each ten cycles of counter 174. If the divide-by-four or five circuit 164 always divides by four, the time for 10 frames is slightly under one second.

The output leads of the divide-by-four circuit 170 are sequenced four times for every interval of an output on one of the leads 1 through 14 from the program counter due to the divide-by-four function. Thus, the lead 1 from the divide-by-four circuit 170 controls the first quarter of the transmission of a pulse and the second through fourth output leads control the second through fourth quarters of the transmission of each pulse.

The output leads 1 through 4 of the divide-by-four circuit 170 are connected to AND gates 178, 180, 182 and 184. Output on the lead 166 equal to "0" produces a divide-by-five in the circuit 164 whereas a "1" produces a divide-by-four. The second input to the gate 184 is grounded so that the fourth quarter, or quadrant, of every pulse will be a "0" and produce a divide-by-five operation. The second input to each of the AND gates 178, 180 and 182 is derived from the programming circuit generally designated by reference numeral 188.

The programming circuit has a first plurality of four AND gates designated in the aggregate as gates 190 each receiving respectively one input from each of the first four output lines, 1–4, of the program counter 174. The other input to each of the four AND gates 190 is derived from the lead 136 which is positive. Thus, during transmission, the output from the first four counts of the program counter 174 are all ones and are fed through OR gate 192 and through an amplifier invertor 194 so that a "0" output is applied to output lead 196 of the invertor 194 during the first four pulse sequences from the program counter 174. The "0" or low output signal on 196 is applied to the gate 178. Therefore, the divide-by-five sequence is initiated and during each first quarter of each pulse, a 2.3 KHz signal is generated. During the second and third quarters of these bits, the OR gate 198 has no imput and the zero output of gate 186 is maintained. The gate 184 is always zero and therefore, the first 4 bits are generated at 2.3 KHz. These are the first four blank bits as illustrated in FIG. 3 illustrating the code format. After the first four bits, the output of invertor 194 reverts to a one level and therefore, the first quarters of all subsequent bits are generated at 2.9 KHz. The program circuit is provided with a further OR gate 198 which receives inputs from AND gate 200 and a further plurality of nine AND gates 202 through 218 for every other reference numeral. The AND gate 200 generates the so-called start bit of the code as illustrated in FIG. 3, and this is accomplished by connecting one input to the fifth output of the program counter and connecting the other input to receive voltage from the lead 136. Thus, during every fifth code bit interval, a positive signal is applied through OR gate 198 to AND gates 180 and 182 whereby a positive signal is generated during the second and third quadrants of the fifth pulse. The gates 202–218 control the transmission during the remaining nine pulse intervals, and the transmission is, of course, determined by the information applied thereto as determined by the settings of the code switches which are generally designated by reference numeral 137. The switches 1–6 determine the coding for the six code bits as illustrated by FIG. 3. The seventh switch determines the channel to be selected. The eighth switch determines whether a delay bit will or will not be transmitted, and the final bit transmitted via the gate 218, is the low battery signal for which there is no switch.

It can be seen that the signal applied to lead 166 varies between a "1" and "0" as determined by the desired transmission, and the output from the divide-by-four or five circuit designated by reference numeral 164 varies between 2.3 KHz and 2.9 KHz which is applied to the input lead 102 to the 395 MHz transmitter generally designated by reference numeral 1.

The transmitter operates as indicated at 395 MHz and provides an AM signal at either of the two code signal frequencies 2.3 KHz or 2.9 KHz which is then received and interpreted at the receiver in the manner previously indicated.

It should be noted that the transmitter is provided with terminals 220 and 222. If the jumper designated by reference numeral 224 is removed, additional switches and magnet combinations may be wired in series between the terminals since the terminals are normally closed in the inoperative condition. The opening of any one of those will break the series circuit and permit the capacitor 152 to charge and produce an alarm signal thus immediately adjacent windows or windows and doors may be wired to a single transmitter reducing the number of transmitters required.

Figure 5:
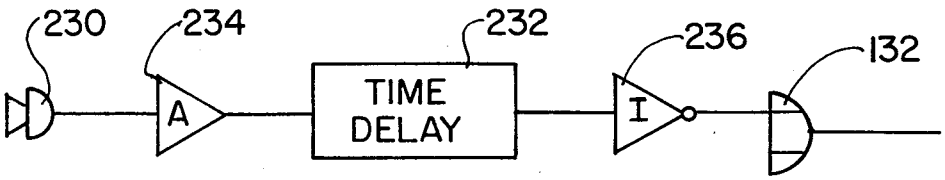
FIG. 5 is a block diagram of a smoke detector responsive transmitter.

Referring specifically to FIG. 5 of the accompanying drawings, there is illustrated a portion of a transmitter for use with a smoke detector. A microphone 230 picks up the sound from an adjacent smoke detector. In order to prevent response to slamming doors and other extraneous noise, a time delay circuit 232 of, for instance, two seconds is inserted in the circuit. The delay circuit is driven from the microphone 230 via an amplifier 234 and its output is provided to an invertor 236 to provide a low level signal to the OR gate 132 of FIG. 4 of the accompanying drawings. In the use of such a device, a push button switch would not normally be employed and thus, the switch 146 of FIG. 4 may be removed and the output of invertor 236 substituted therefore.

The transmitter of the apparatus of FIG. 5 would normally transmit a panic signal on Channel 2 and produce an immediate and very loud response to sounding of the smoke detector. An audio feedback loop is prevented by the pulse every thirty seconds from generator 118.

If the smoke detector is located near a door or window, this transmitter may serve both functions but only if the panic mode is not set into the transmitter.

The program for the microprocessor 9 is as follows:

The program for the microprocessor 9 is as follows:

```
LOC  OBJ        LINE        SOURCE STATEMENT

                   1 $TITLE('USI BURGLAR ALARM  9/27/79') PAGEWIDTH(96) XREF
                   2 ;C DOELLER FOR MICROCOM DESIGN INC
                   3 ;COMMENTS MODIFIED 10/10/79
                   4 ;
                   5 ;
                   6 ;      REGISTER EQUATES.
                   7 ;
                   8 ;
0018               9 XD1      EQU     24      ;?????
0019              10 XD2      EQU     25      ;?????
001A              11 XD3      EQU     26      ;?????
001B              12 XD4      EQU     27      ;?????
001C              13 XD5      EQU     28      ;?????
001D              14 DATASR   EQU     29
001E              15 BITCNT   EQU     30
001F              16 XD6      EQU     31      ;?????
0020              17 TIM1     EQU     32
0021              18 TIM2     EQU     33
0022              19 TIM3     EQU     34
0023              20 TIM4     EQU     35
0024              21 TIM5     EQU     36
0025              22 TIM6     EQU     37
0026              23 TIM7     EQU     38
0027              24 TIM8     EQU     39
0028              25 NULCNT   EQU     40
0029              26 DBCNT    EQU     41
002A              27 ALSTAT   EQU     42
002B              28 FLSTAT   EQU     43
```

```
002C          29 MDSTAT  EQU    44
002D          30 TMSTAT  EQU    45
002E          31 OPSTAT  EQU    46
002F          32 CMJMP   EQU    47
0030          33 CMCNT   EQU    48
0031          34 MSG0    EQU    49
0032          35 MSG1    EQU    50
0033          36 MSG2    EQU    51
0034          37 MSG3    EQU    52
0035          38 MSG4    EQU    53
0036          39 MSG5    EQU    54
0037          40 MSG6    EQU    55
0038          41 MSG7    EQU    56
0039          42 COD1    EQU    57
003A          43 COD2    EQU    58
003B          44 COD3    EQU    59
003C          45 DLYNO   EQU    60
003D          46 DLYCNT  EQU    61
003E          47 MANMEM  EQU    62
003F          48 LKSTAT  EQU    63
0040          49 TIM9    EQU    64
0041          50 TIM10   EQU    65
0042          51 TKSTAT  EQU    66
              52 ;
              53 ;       MODE STATUS BITS.
              54 ;
0001          55 STBYMD  EQU    01H    ;BIT   0
0002          56 DLYMD   EQU    02H    ;BIT   1
0004          57 BATFLT  EQU    04H    ;BIT   2
0008          58 ALCLMD  EQU    08H    ;BIT   3
0010          59 SILMD   EQU    10H    ;BIT   4
0020          60 AL2MD   EQU    20H    ;BIT   5
0040          61 AL1MD   EQU    40H    ;BIT   6
0080          62 ARMMD   EQU    80H    ;BIT   7
              63 ;
              64 ;       FLAG STATUS BITS.
              65 ;
0001          66 FIRFLG  EQU    01H    ;BIT   0
0002          67 TSTFLG  EQU    02H    ;BIT   1
0004          68 CMFLG   EQU    04H    ;BIT   2
0008          69 BBTFLG  EQU    08H    ;BIT   3
0010          70 SCFLG   EQU    10H    ;BIT   4
0020          71 DLY2FL  EQU    20H    ;BIT   5
0040          72 DLY1FL  EQU    40H    ;BIT   6
0080          73 RCVFLG  EQU    80H    ;BIT   7
              74 ;
              75 ;       TIME STATUS BITS.
              76 ;
0001          77 SEC3M1  EQU    01H    ;BIT   0
0002          78 SEC3M2  EQU    02H    ;BIT   1
0004          79 SEC3D1  EQU    04H    ;BIT   2
0008          80 SEC3D2  EQU    08H    ;BIT   3
0010          81 SEC5M1  EQU    10H    ;BIT   4
0020          82 SEC5M2  EQU    20H    ;BIT   5
0040          83 SEC5D1  EQU    40H    ;BIT   6
0080          84 MIN10M  EQU    80H    ;BIT   7
              85 ;
              86 ;       ALARM STATUS BITS.
              87 ;
0020          88 ALRMM2  EQU    20H    ;BIT   5
0040          89 ALRMM1  EQU    40H    ;BIT   6
              90 ;
              91 ;OPERATE STATUS BITS.
              92 ;
0001          93 DBFLG   EQU    01H    ;BIT   0
```

```
                 94 ;
                 95 ;        AUDIO CONTROL BITS
                 96 ;
0010             97 AUDEN    EQU     10H     ;BIT 4
0020             98 HIFREQ   EQU     20H     ;BIT 5
0040             99 LOVOL    EQU     40H     ;BIT 6
0080            100 ATICK    EQU     80H     ;BIT 7
0040            101 INTRES   EQU     40H     ;BIT 6
0002            102 FDFLG    EQU     02H     ;BIT 1
                103 $EJECT
                104 ;
                105 ;*****************************************
                106 ;       START OF PROGRAM
                107 ;*****************************************
                108 ;
0000            109          ORG     0
0000 A482       110          JMP     XEQ
0002 00         111          NOP
0003 040A       112          JMP     DATINT
0005 00         113          NOP
0006 00         114          NOP
0007 1430       115          CALL    TIMER
0009 93         116          RETR
000A 362B       117 DATINT:  JT0     DATRET  ;NO LOCK
000C 55         118          STRT    T
000D D5         119          SEL     RB1
000E 2A         120          XCH     A,R2    ;SAVE ACCUMULATOR
000F 42         121          MOV     A,T
0010 AB         122          MOV     R3,A    ;SAVE TIMER VALUE
0011 23E8       123          MOV     A,#-24
0013 62         124          MOV     T,A
0014 35         125          DIS     TCNTI
0015 25         126          EN      TCNTI   ;INIT TIMER
0016 FB         127          MOV     A,R3
0017 07         128          DEC     A
0018 030D       129          ADD     A,#13
001A E61E       130          JNC     DATA1   ;LESS THAN HALF TIME
001C 1437       131          CALL    TIMER1
001E B828       132 DATA1:   MOV     R0,#NULCNT
0020 B005       133          MOV     @R0,#5  ;INIT NULL TIMER
0022 A5         134          CLR     F1
0023 B5         135          CPL     F1
0024 B82B       136          MOV     R0,#FLSTAT
0026 F0         137          MOV     A,@R0
0027 4380       138          ORL     A,#RCVFLG
0029 A0         139          MOV     @R0,A   ;SET RECEIVER FLAG
002A 2A         140          XCH     A,R2    ;RESTORE ACCUMULATOR
002B 99BF       141 DATRET:  ANL     P1,#NOT(INTRES)
002D 8940       142          ORL     P1,#INTRES
002F 93         143          RETR            ;END OF ROUTINE
0030 D5         144 TIMER:   SEL     RB1
0031 2A         145          XCH     A,R2    ;SAVE ACCUMULATOR
0032 23E8       146          MOV     A,#(-24)
0034 62         147          MOV     T,A     ;RESET TIME
0035 76BD       148          JF1     RCVSTB  ;STROBE IN DATA
0037 BF00       149 TIMER1:  MOV     R7,#0   ;CLEAR TIME FLAGS
0039 B820       150          MOV     R0,#TIM1
003B F0         151          MOV     A,@R0
003C 07         152          DEC     A
003D 9657       153          JNZ     TXIT1   ;NOT 1/3 SECOND
003F B079       154          MOV     @R0,#121
0041 BF03       155          MOV     R7,#03H ;UPDATE TIME FLAGS
0043 18         156          INC     R0
0044 10         157          INC     @R0     ;INC 1/3 SECOND COUNTER
0045 18         158          INC     R0
```

```
0046 F0          159          MOV    A,@R0
0047 07          160          DEC    A
0048 9657        161          JNZ    TXIT1    ;NOT 5 SECOND
004A B00F        162          MOV    @R0,#15
004C BF33        163          MOV    R7,#33H ;UPDATE TIME FLAGS
004E 18          164          INC    R0
004F F0          165          MOV    A,@R0
0050 07          166          DEC    A
0051 9657        167          JNZ    TXIT1    ;NOT 10 MINUTES
0053 2378        168          MOV    A,#120
0055 BFB3        169          MOV    R7,#0B3H        ;UPDATE TIME FLAGS
0057 A0          170 TXIT1:   MOV    @R0,A
0058 B824        171          MOV    R0,#TIM5
005A F0          172          MOV    A,@R0
005B 07          173          DEC    A
005C 966F        174          JNZ    TXIT2    ;NOT 1/3 SECOND
005E B079        175          MOV    @R0,#121
0060 FF          176          MOV    A,R7
0061 430C        177          ORL    A,#0CH
0063 AF          178          MOV    R7,A     ;UPDATE TIME FLAGS
0064 18          179          INC    R0
0065 F0          180          MOV    A,@R0
0066 07          181          DEC    A
0067 966F        182          JNZ    TXIT2    ;NOT 5 SECOND
0069 230F        183          MOV    A,#15
006B 2F          184          XCH    A,R7
006C 4340        185          ORL    A,#40H
006E 2F          186          XCH    A,R7     ;UPDATE TIME FLAGS
006F A0          187 TXIT2:   MOV    @R0,A
0070 B826        188          MOV    R0,#TIM7
0072 F0          189          MOV    A,@R0
0073 07          190          DEC    A
0074 A0          191          MOV    @R0,A
0075 967B        192          JNZ    TXIT3    ;NOT 1/8 SECOND
0077 B02D        193          MOV    @R0,#45
0079 18          194          INC    R0
007A 10          195          INC    @R0      ;UPDATE 1/8 SECOND COUNTER
007B B828        196 TXIT3:   MOV    R0,#NULCNT
007D F0          197          MOV    A,@R0
007E 07          198          DEC    A
007F A0          199          MOV    @R0,A    ;DECREMENT NULL COUNTER
0080 9684        200          JNZ    NULXIT
0082 AD          201          MOV    R5,A
0083 AE          202          MOV    R6,A
0084 18          203 NULXIT:  INC    R0
0085 10          204          INC    @R0      ;INCREMENT DBCNT
0086 F0          205          MOV    A,@R0
0087 968D        206          JNZ    TXIT4    ;NOT ZERO
0089 B82E        207          MOV    R0,#OPSTAT
008B B000        208          MOV    @R0,#0   ;CLEAR DEBOUNCE FLAG
008D 36B2        209 TXIT4:   JT0    ENLK     ;NO LOCK
008F B83F        210          MOV    R0,#LKSTAT
0091 F0          211          MOV    A,@R0
0092 129F        212          JB0    PREVLK   ;HAD LOCK EARLIER
0094 B001        213          MOV    @R0,#1   ;SET LOCK FLAG
0096 B840        214 LKTMST:  MOV    R0,#TIM9
0098 B000        215          MOV    @R0,#0
009A 18          216          INC    R0
009B B003        217          MOV    @R0,#3   ;INIT LOCK TIMER
009D 04B6        218          JMP    TXIT5
009F B840        219 PREVLK:  MOV    R0,#TIM9
00A1 F0          220          MOV    A,@R0
00A2 07          221          DEC    A
00A3 A0          222          MOV    @R0,A
00A4 96B6        223          JNZ    TXIT5    ;NOT FINISHED
```

```
00A6 18          224          INC    R0
00A7 F0          225          MOV    A,@R0
00A8 07          226          DEC    A
00A9 A0          227          MOV    @R0,A
00AA 96B6        228          JNZ    TXIT5    ;NOT FINISHED
00AC B83F        229          MOV    R0,#LKSTAT
00AE B003        230          MOV    @R0,#3   ;SET FORCE DECODE FLAG
00B0 0496        231          JMP    LKTMST   ;REINIT LOCK TIMER
00B2 B83F        232 ENLK:    MOV    R0,#LKSTAT
00B4 B000        233          MOV    @R0,#0   ;CLEAR LOCK TIMER WHEN NO LOCK
00B6 B82D        234 TXIT5:   MOV    R0,#TMSTAT
00B8 F0          235          MOV    A,@R0
00B9 4F          236          ORL    A,R7
00BA A0          237          MOV    @R0,A    ;UPDATE TIME FLAGS
00BB FA          238          MOV    A,R2     ;RESTORE ACCUMULATOR
00BC 83          239          RET
00BD A5          240 RCVSTB:  CLR    F1
00BE 97          241          CLR    C
00BF 46C2        242          JNT1   RCVST1   ;INPUT = 0
00C1 A7          243          CPL    C        ;INPUT = 1
00C2 FD          244 RCVST1:  MOV    A,R5
00C3 F7          245          RLC    A
00C4 AD          246          MOV    R5,A     ;UPDATE WORD
00C5 1E          247          INC    R6       ;INCREMENT BIT COUNT
00C6 FE          248          MOV    A,R6
00C7 03F9        249          ADD    A,#(-7)
00C9 C6DE        250          JZ     RBIT7    ;7TH BIT
00CB E637        251          JNC    TIMER1   ;1ST - 6TH BITS
00CD 03FD        252          ADD    A,#(-3)
00CF E637        253          JNC    TIMER1   ;8TH - 9TH BITS
00D1 FD          254 RBIT10:  MOV    A,R5     ;10TH BIT
00D2 D301        255          XRL    A,#1
00D4 AD          256          MOV    R5,A     ;INVERT BATT BIT
00D5 0331        257          ADD    A,#MSG0
00D7 A9          258          MOV    R1,A
00D8 11          259          INC    @R1      ;INCREMENT MSG (N)
00D9 27          260 WINIT:   CLR    A
00DA AE          261          MOV    R6,A     ;CLEAR BIT COUNT
00DB AD          262 WINIT1:  MOV    R5,A     ;CLEAR WORD
00DC 0437        263          JMP    TIMER1
00DE 08          264 RBIT7:   INS    A,BUS    ;READ IDENT
00DF DD          265          XRL    A,R5
00E0 533F        266          ANL    A,#3FH
00E2 96D9        267          JNZ    WINIT    ;NOT PROPER IDENT
00E4 04DB        268          JMP    WINIT1   ;PROPER IDENT
0100             269          ORG    100H
0100 BA00        270 MLRCV:   MOV    R2,#0    ;INVALID DECODE
0102 B83F        271          MOV    R0,#LKSTAT
0104 F0          272          MOV    A,@R0
0105 B82B        273          MOV    R0,#FLSTAT
0107 320F        274          JB1    DECODE   ;FORCE DECODE FLAG SET
0109 F0          275          MOV    A,@R0
010A 37          276          CPL    A
010B F239        277          JB7    RXIT2    ;NOT RECEIVING
010D 2639        278          JNT0   RXIT2    ;LOCK
010F 15          279 DECODE:  DIS    I
0110 F0          280          MOV    A,@R0
0111 537F        281          ANL    A,#NOT(RCVFLG)
0113 A0          282          MOV    @R0,A    ;RESET RECEIVER FLAG
0114 B808        283          MOV    R0,#8
0116 B938        284          MOV    R1,#MSG7
0118 F1          285 DCDLP:   MOV    A,@R1    ;MESSAGE TOTAL
0119 03FD        286          ADD    A,#(-3)
011B F620        287          JC     RXIT1    ;3 OR MORE
011D C9          288          DEC    R1
```

```
011E E818          289          DJNZ    R0,DCDLP
0120 F8            290 RXIT1:   MOV     A,R0
0121 AA            291          MOV     R2,A     ;SAVE MESSAGE NUMBER
0122 07            292          DEC     A
0123 AB            293          MOV     R3,A
0124 B808          294          MOV     R0,#8
0126 B938          295          MOV     R1,#MSG7
0128 27            296          CLR     A
0129 A1            297 DCDZRO:  MOV     @R1,A
012A C9            298          DEC     R1
012B E829          299          DJNZ    R0,DCDZRO        ;CLEAR MESSAGE COUNTERS
012D B91D          300          MOV     R1,#DATASR
012F A1            301          MOV     @R1,A    ;CLEAR WORD
0130 19            302          INC     R1
0131 A1            303          MOV     @R1,A    ;CLEAR BIT COUNTER
0132 B83F          304          MOV     R0,#LKSTAT
0134 F0            305          MOV     A,@R0
0135 53FD          306          ANL     A,#NOT(FDFLG)
0137 A0            307          MOV     @R0,A
0138 05            308          EN      I
0139 B82B          309 RXIT2:   MOV     R0,#FLSTAT
013B B92C          310          MOV     R1,#MDSTAT
013D F1            311          MOV     A,@R1
013E F273          312          JB7     RXIT3    ;ARM OR TEST MODE
0140 FA            313          MOV     A,R2
0141 C673          314          JZ      RXIT3    ;INVALID MESSAGE
0143 1273          315          JB0     RXIT3    ;BATTERY MESSAGE
0145 FB            316          MOV     A,R3
0146 37            317          CPL     A
0147 5259          318          JB2     NOFIRE   ;CHANNEL 1
0149 09            319          IN      A,P1
014A 37            320          CPL     A
014B F259          321          JB7     NOFIRE   ;NOT FIRE CHANNEL
014D F0            322 FIRE:    MOV     A,@R0
014E 12A0          323          JB0     ATJ1     ;FIRE FLAG SET
0150 4321          324          ORL     A,#(FIRFLG OR DLY2FL)
0152 A0            325          MOV     @R0,A
0153 8A30          326          ORL     P2,#(AUDEN OR HIFREQ)    ;ENABLE AUDIO
0155 9ABF          327          ANL     P2,#NOT(LOVOL)  ;MAX VOLUME
0157 440D          328          JMP     FIRALM
0159 F0            329 NOFIRE:  MOV     A,@R0
015A 5360          330          ANL     A,#(DLY1FL OR DLY2FL)
015C C66C          331          JZ      AL12CK   ;NO DELAY FLAGS
015E BF20          332          MOV     R7,#DLY2FL
0160 FB            333          MOV     A,R3
0161 5265          334          JB2     SETCH    ;CHANNEL = 2
0163 BF40          335          MOV     R7,#DLY1FL       ;CHANNEL = 1
0165 F0            336 SETCH:   MOV     A,@R0
0166 4F            337          ORL     A,R7
0167 A0            338          MOV     @R0,A    ;SET DELAY FLAG
0168 FB            339          MOV     A,R3
0169 37            340          CPL     A
016A 3297          341          JB1     JDLYOF   ;NON DELAY MESSAGE
016C F1            342 AL12CK:  MOV     A,@R1
016D D273          343          JB6     RXIT3    ;ALARM 1
016F B273          344          JB5     RXIT3    ;ALARM 2
0171 BA00          345          MOV     R2,#0    ;INVALID MESSAGE
0173 FA            346 RXIT3:   MOV     A,R2
0174 C67F          347          JZ      RXIT4    ;NON VALID
0176 37            348          CPL     A
0177 1287          349          JB0     ALARM    ;NOT BATTERY MESSAGE
0179 BA00          350          MOV     R2,#0
017B F1            351          MOV     A,@R1
017C 4304          352          ORL     A,#BATFLT
017E A1            353          MOV     @R1,A    ;SET BATT FLAG
```

```
017F F0          354 RXIT4:  MOV   A,@R0
0180 41          355         ORL   A,@R1
0181 D287        356         JB6   ALARM    ;ALARM MODE 1 OR DLY1FLG
0183 B287        357         JB5   ALARM    ;ALARM MODE 2 OR DLY2FLG
0185 44B4        358         JMP   AXIT
0187 F1          359 ALARM:  MOV   A,@R1
0188 37          360         CPL   A
0189 1280        361         JB0   DJ3      ;NOT STANDBY MODE
018B 441F        362         JMP   ATEST    ;STANDBY MODE
018D FA          363 DJ3:    MOV   A,R2
018E 9699        364         JNZ   DJ4      ;VALID MESSAGE
0190 F0          365         MOV   A,@R0
0191 5360        366         ANL   A,#(DLY1FL OR DLY2FL)
0193 96F1        367         JNZ   TIMCHK   ;IF DELAY FLAGS ARE SET
0195 4451        368         JMP   ATIME
0197 4403        369 JDLYOF: JMP   DLYOFF
0199 FB          370 DJ4:    MOV   A,R3
019A 52C3        371         JB2   CH2TST   ;CHANNEL 2
019C F1          372         MOV   A,@R1    ;CHANNEL 1
019D 37          373         CPL   A
019E D2A2        374         JB6   DJ1      ;NO ALARM 1
01A0 4451        375 ATJ1:   JMP   ATIME    ;IF ALARM
01A2 F0          376 DJ1:    MOV   A,@R0
01A3 D2F1        377         JB6   TIMCHK   ;DELAY FLAG 1
01A5 4340        378         ORL   A,#DLY1FL
01A7 A0          379         MOV   @R0,A    ;SET DELAY FLAG 1
01A8 F1          380         MOV   A,@R1
01A9 537F        381         ANL   A,#NOT(ARMMD)
01AB A1          382         MOV   @R1,A    ;ARM MODE OFF
01AC F0          383         MOV   A,@R0
01AD B2F1        384         JB5   TIMCHK   ;DELAY FLAG 2
01AF F1          385         MOV   A,@R1
01B0 B2DD        386         JB5   SET2AL   ;ALARM 2
01B2 FB          387 DLYCHK: MOV   A,R3
01B3 37          388         CPL   A
01B4 3297        389         JB1   JDLYOF   ;NON DELAY MESSAGE
01B6 F1          390         MOV   A,@R1
01B7 37          391         CPL   A
01B8 3297        392         JB1   JDLYOF   ;NO DELAY MODE
01BA B83C        393         MOV   R0,#DLYNO
01BC F0          394         MOV   A,@R0
01BD 18          395         INC   R0
01BE A0          396         MOV   @R0,A    ;INIT DELAY COUNT
01BF B82B        397         MOV   R0,#FLSTAT
01C1 443C        398         JMP   ATIMR
01C3 09          399 CH2TST: IN    A,P1
01C4 F24D        400         JB7   FIRE     ;FIRE CHANNEL
01C6 F1          401         MOV   A,@R1
01C7 37          402         CPL   A
01C8 B2CC        403         JB5   DJ2      ;NO ALARM 2
01CA 4451        404         JMP   ATIME    ;ALARM
01CC F0          405 DJ2:    MOV   A,@R0
01CD B2F1        406         JB5   TIMCHK   ;DELAY FLAG 2
01CF 4320        407         ORL   A,#DLY2FL
01D1 A0          408         MOV   @R0,A    ;SET DELAY FLAG 2
01D2 F1          409         MOV   A,@R1
01D3 537F        410         ANL   A,#NOT(ARMMD)
01D5 A1          411         MOV   @R1,A    ;TURN OFF ARM
01D6 F0          412         MOV   A,@R0
01D7 D2F1        413         JB6   TIMCHK   ;DELAY FLAG 1
01D9 F1          414         MOV   A,@R1
01DA 37          415         CPL   A
01DB D2B2        416         JB6   DLYCHK   ;NO ALARM 1
01DD F1          417 SET2AL: MOV   A,@R1
01DE 4368        418         ORL   A,#(AL1MD OR AL2MD OR ALCLMD)
```

```
01E0 A1          419          MOV     @R1,A    ;SET BOTH ALARMS
01E1 C8          420          DEC     R0
01E2 B060        421          MOV     @R0,#(ALRMM1 OR ALRMM2) ;SET ALARM MEMORIE
01E4 18          422          INC     R0
01E5 F0          423          MOV     A,@R0
01E6 85          424          CLR     F0       ;F0 = 0 IF DELAY FLAG 1
01E7 D2EA        425          JB6     ADDCH1   ;IF DELAY FLAG 1
01E9 95          426          CPL     F0       ;F0 = 1 FOR DELAY FLAG 2
01EA 539F        427 ADDCH1:  ANL     A,#NOT(DLY1FL OR DLY2FL)
01EC A0          428          MOV     @R0,A
01ED B6A0        429          JF0     ATJ1     ;IF CHANNEL 2
                 430 ;
                 431 ;*************************************************
                 432 ;        CORRECTION NOT IN PRESENT PROGRAM
                 433 ;*************************************************
                 434 ;
0001             435 TRUE     EQU     1
0000             436 FALSE    EQU     0
0000             437 FIXERR   EQU     FALSE
                 438 ;
                 439          IF      FIXERR EQ TRUE
                 440          CPL     A
                 441          JB0     ATJ1     ;NOT FIRE
                 442          ENDIF
                 443 ;
01EF 443C        444          JMP     ATIMR    ;IF CHANNEL 1 AFTER FIRE
01F1 19          445 TIMCHK:  INC     R1       ;R1 = TMSTAT
01F2 F1          446          MOV     A,@R1
01F3 92F7        447          JB4     DLYCK    ;5 SEC FLAG
01F5 44B4        448          JMP     AXIT     ;R1*
01F7 53EF        449 DLYCK:   ANL     A,#NOT(SEC5M1)
01F9 A1          450          MOV     @R1,A    ;CLEAR 5 SEC FLAG
01FA B93D        451          MOV     R1,#DLYCNT
01FC F1          452          MOV     A,@R1
01FD 07          453          DEC     A
01FE A1          454          MOV     @R1,A    ;DECREMENT DELAY COUNT
01FF C603        455          JZ      DLYOFF   ;END OF DELAY TIME
0201 44B4        456          JMP     AXIT     ;MORE DELAY TIME
0203 B92C        457 DLYOFF:  MOV     R1,#MDSTAT
0205 F1          458          MOV     A,@R1
0206 920A        459          JB4     RLYON    ;SILENT
0208 8A30        460          ORL     P2,#(AUDEN OR HIFREQ)   ;ENABLE AUDIO
020A 4308        461 RLYON:   ORL     A,#ALCLMD        ;CLOSE RELAY
020C A1          462          MOV     @R1,A
020D F0          463 FIRALM:  MOV     A,@R0
020E 5360        464          ANL     A,#(DLY1FL OR DLY2FL)
0210 AF          465          MOV     R7,A     ;SAVE FLAGS
0211 F1          466          MOV     A,@R1
0212 4F          467          ORL     A,R7
0213 A1          468          MOV     @R1,A    ;TURN ON ALARM
0214 C8          469          DEC     R0       ;R0 = ALSTAT
0215 F0          470          MOV     A,@R0
0216 4F          471          ORL     A,R7
0217 A0          472          MOV     @R0,A    ;SET ALARM MEMORIES
0218 18          473          INC     R0       ;R0 = FLSTAT
0219 F0          474          MOV     A,@R0
021A 539F        475          ANL     A,#NOT(DLY1FL OR DLY2FL)
021C A0          476          MOV     @R0,A    ;TURN OFF DELAY FLAGS
021D 443C        477          JMP     ATIMR
021F F1          478 ATEST:   MOV     A,@R1
0220 5360        479          ANL     A,#(AL1MD OR AL2MD)
0222 C629        480          JZ      TALCHK   ;NO ALARMS
0224 F0          481          MOV     A,@R0
0225 92B4        482          JB4     AXIT     ;SET CODE MODE
0227 4451        483          JMP     ATIME
0229 FA          484 TALCHK:  MOV     A,R2
```

```
022A C6B4          485          JZ      AXIT     ;INVALID DECODE
022C FB            486          MOV     A,R3
022D BF20          487          MOV     R7,#DLY2FL
022F 5233          488          JB2     TALON    ;TEST ALARM 2
0231 BF40          489          MOV     R7,#DLY1FL       ;TEST ALARM 1
0233 F1            490 TALON:   MOV     A,@R1
0234 4F            491          ORL     A,R7
0235 A1            492          MOV     @R1,A    ;TURN ON TEST ALARM
0236 8A30          493          ORL     P2,#(AUDEN OR HIFREQ)
0238 F0            494          MOV     A,@R0
0239 4302          495          ORL     A,#TSTFLG
023B A0            496          MOV     @R0,A    ;SET TEST FLAG
023C 35            497 ATIMR:   DIS     TCNTI
023D B920          498          MOV     R1,#TIM1
023F B179          499          MOV     @R1,#121
0241 19            500          INC     R1
0242 B100          501          MOV     @R1,#0
0244 19            502          INC     R1
0245 B10F          503          MOV     @R1,#15
0247 19            504          INC     R1
0248 B178          505          MOV     @R1,#120         ;INIT TIMER
024A B92D          506          MOV     R1,#TMSTAT
024C F1            507          MOV     A,@R1
024D 534C          508          ANL     A,#NOT *
024F A1            509          MOV     @R1,A    ;CLEAR TIMER FLAGS
0250 25            510          EN      TCNTI
0251 B92D          511 ATIME:   MOV     R1,#TMSTAT
0253 F1            512          MOV     A,@R1
0254 1259          513          JB0     TIMTST   ;5 SEC FLAG
0256 C9            514          DEC     R1       ;R1 = MDSTAT
0257 448B          515          JMP     OFFTIM
0259 53FE          516 TIMTST:  ANL     A,#NOT(SEC3M1)
025B A1            517          MOV     @R1,A
025C C9            518          DEC     R1       ;R1 = MDSTAT
025D F0            519          MOV     A,@R0
025E 128B          520          JB0     OFFTIM   ;FIRE FLAG
0260 3265          521          JB1     AUDCTL   ;TEST FLAG
0262 F1            522          MOV     A,@R1
0263 928B          523          JB4     OFFTIM   ;SILENT
0265 B921          524 AUDCTL:  MOV     R1,#TIM2
0267 F1            525          MOV     A,@R1
0268 B92C          526          MOV     R1,#MDSTAT
026A 37            527          CPL     A
026B 5303          528          ANL     A,#03H
026D AF            529          MOV     R7,A     ;1/3 SEC COUNT SAVED
026E F1            530          MOV     A,@R1
026F B27C          531          JB5     FIRCH    ;ALARM 2
0271 FF            532          MOV     A,R7
0272 1278          533          JB0     SONHI    ;CYCLE 1 OR 3
0274 9ADF          534 SONLO:   ANL     P2,#NOT(HIFREQ) ;ENABLE LOW TONE
0276 448B          535          JMP     OFFTIM
0278 8A30          536 SONHI:   ORL     P2,#(AUDEN OR HIFREQ)   ;ENABLE HIGH TONE
027A 448B          537          JMP     OFFTIM
027C 09            538 FIRCH:   IN      A,P1
027D F28B          539          JB7     OFFTIM   ;CHANNEL 2 & FIRE
027F FF            540          MOV     A,R7
0280 C689          541          JZ      SONOFF   ;CYCLE 4
0282 1278          542          JB0     SONHI    ;CYCLE 1 OR 3
0284 F1            543          MOV     A,@R1
```

* (MIN10M OR SEC5M2 OR SEC5M1 OR SEC3M2 OR SEC3M1)

```
0285 D274          544          JB6     SONLO    ;ALARM 1 AND 2
0287 4478          545          JMP     SONHI    ;ALARM 2 ONLY
0289 9ACF          546 SONOFF:  ANL     P2,#NOT(AUDEN OR HIFREQ);DISABLE AUDIO
028B F0            547 OFFTIM:  MOV     A,@R0
028C 37            548          CPL     A
028D 1291          549          JB0     TIMOUT   ;NO FIRE FLAG
028F 9ABF          550          ANL     P2,#NOT(LOVOL)  ;MAX VOLUME
0291 F1            551 TIMOUT:  MOV     A,@R1
0292 129A          552          JB0     ATEST1   ;STANDBY
0294 19            553          INC     R1       ;R1 = TMSTAT
0295 F1            554          MOV     A,@R1
0296 F2A3          555          JB7     AAOFF    ;10 MIN FLAG
0298 44B4          556          JMP     AXIT
029A B922          557 ATEST1:  MOV     R1,#TIM3
029C F1            558          MOV     A,@R1
029D 72B4          559          JB3     AXIT     ;<2.7 SEC
029F F0            560          MOV     A,@R0
02A0 53FD          561          ANL     A,#NOT(TSTFLG)  ;RESET TEST FLAG
02A2 A0            562          MOV     @R0,A
02A3 B92C          563 AAOFF:   MOV     R1,#MDSTAT
02A5 F1            564          MOV     A,@R1
02A6 5387          565          ANL     A,#NOT(AL1MD OR ALCLMD)
02A8 A1            566          MOV     @R1,A    ;RESET RELAY AND ALARM 1
02A9 F0            567          MOV     A,@R0
02AA 12B4          568          JB0     AXIT     ;FIRE FLAG SET
02AC F1            569          MOV     A,@R1
02AD 53DF          570          ANL     A,#NOT(AL2MD)    ;RESET FIRE ALARM
02AF 4380          571          ORL     A,#ARMMD         ;SET ARM MODE
02B1 A1            572          MOV     @R1,A
02B2 9ACF          573          ANL     P2,#NOT(AUDEN OR HIFREQ) ;DISABLE AUDIO
02B4 08            574 AXIT:    INS     A,BUS
02B5 D2C5          575          JB6     LSTAT    ;AC POWER OK
02B7 B927          576          MOV     R1,#TIM8
02B9 F1            577          MOV     A,@R1
02BA 5307          578          ANL     A,#07H
02BC C6C5          579          JZ      LSTAT    ;CORRECT 1/8 SEC
02BE B92C          580          MOV     R1,#MDSTAT
02C0 F1            581          MOV     A,@R1
02C1 5308          582          ANL     A,#ALCLMD        ;CLEAR LED DRIVERS
02C3 44D3          583          JMP     LOUT
02C5 85            584 LSTAT:   CLR     F0
02C6 B927          585          MOV     R1,#TIM8
02C8 F1            586          MOV     A,@R1
02C9 B92C          587          MOV     R1,#MDSTAT
02CB 72CE          588          JB3     ORTEST   ;IF ODD SECOND
02CD 95            589          CPL     F0
02CE F1            590 ORTEST:  MOV     A,@R1
02CF C8            591          DEC     R0
02D0 B6D3          592          JF0     LOUT     ;IF ODD SECOND
02D2 40            593          ORL     A,@R0    ;OR IN ALARM MEMORY AT EVEN SECONDS
02D3 9426          594 LOUT:    CALL    LSTOR    ;UPDATE LAMP DRIVERS
02D5 B842          595          MOV     R0,#TKSTAT
02D7 B000          596          MOV     @R0,#0   ;CLEAR TKSTAT
02D9 643B          597          JMP     KYBD
                   598 ;
                   599 ;
                   600 ;
                   601 ;     PAGE 3.
                   602 ;
                   603 ;
0300               604          ORG     300H
0300 11            605 KYTB:    DB      17 ;  BATT RESET
0301 0F            606          DB      15 ;  BATT TEST
0302 14            607          DB      20 ;  SYSTEM TEST
0303 0D            608          DB      13 ;  SET CODE
```

```
0304 0C          609          DB      12 ;  SET DELAY
0305 03          610          DB      03 ;  "3"
0306 06          611          DB      06 ;  "6"
0307 09          612          DB      09 ;  "9"
0308 10          613          DB      16 ;  LAMP TEST
0309 0E          614          DB      14 ;  SILENT
030A 02          615          DB      02 ;  "2"
030B 05          616          DB      05 ;  "5"
030C 08          617          DB      08 ;  "8"
030D 0A          618          DB      10 ;  "0"
030E 12          619          DB      18 ;  ARM DELAY
030F 01          620          DB      01 ;  "1"
0310 04          621          DB      04 ;  "4"
0311 07          622          DB      07 ;  "7"
0312 0B          623          DB      11 ;  ALRM RST
0313 13          624          DB      19 ;  ARM
0314 A47C        625          JMP     RALLMP
0316 8486        626          JMP     SETDEL
0318 846B        627          JMP     SETCOD
031A A400        628          JMP     SILENT
031C 8400        629          JMP     BATTST
031E A408        630          JMP     LMPTST
0320 A412        631          JMP     RBFLMP
0322 84BC        632          JMP     ARMWD
0324 847C        633          JMP     ARM
0326 A41A        634          JMP     TEST
0328 8440        635          JMP     NEWCD
032A 2400        636 JRCVR:   JMP     MLRCV
032C A439        637 RESET:   JMP     RESETX
                 638 ;
032E 14          639 JOFF:    DB      14H ;  RALLMP
032F 16          640          DB      16H ;  SETDEL
0330 18          641          DB      18H ;  SETCOD
0331 1A          642          DB      1AH ;  SILENT
0332 1C          643          DB      1CH ;  BATTST
0333 1E          644          DB      1EH ;  LMPTST
0334 20          645          DB      20H ;  RBFLMP
0335 22          646          DB      22H ;  ARMWD
0336 24          647          DB      24H ;  ARM
0337 26          648          DB      26H ;  TEST
0338 28          649          DB      28H ;  NEWCD
0339 2A          650          DB      2AH ;  TIMER
033A 2C          651          DB      2CH ;  RESETX
                 652 ;
033B B83E        653 KYBD:    MOV     R0,#MANMEM
033D E0          654          MOV     A,@R0
033E AD          655          MOV     R5,A     ;SAVE LAST VALUE OF P1
033F 09          656          IN      A,P1
0340 A0          657          MOV     @R0,A    ;SAVE NEW VALUE OF P1
0341 B249        658          JB5     NEW1     ;NEW VALUE IS 1
0343 DD          659          XRL     A,R5     ;NEW VALUE IS 0
0344 37          660          CPL     A
0345 B24F        661          JB5     KEYBD    ;VALUE DID NOT CHANGE
0347 A422        662          JMP     REINIT   ;VALUE CHANGED TO 0
0349 DD          663 NEW1:    XRL     A,R5
034A 37          664          CPL     A
034B B24F        665          JB5     KEYBD    ;VALUE DID NOT CHANGE
034D 847C        666          JMP     ARM      ;VALUE CHANGED TO 1
034F B82C        667 KEYBD:   MOV     R0,#MDSTAT
0351 F0          668          MOV     A,@R0    ;MDSTAT
0352 37          669 TIKTST:  CPL     A
0353 5260        670          JB2     NOTICK   ;NO BATTFLT
0355 B827        671          MOV     R0,#TIMS
0357 F0          672          MOV     A,@R0
0358 530F        673          ANL     A,#0FH
```

```
035A 9660          674          JNZ     NOTICK  ;NOT TIME FOR TICK
035C 9A7F          675          ANL     P2,#NOT(ATICK)  ;OUTPUT TICK
035E 6462          676          JMP     KYBD1
0360 8A80          677 NOTICK:  ORL     P2,#ATICK
0362 B82E          678 KYBD1:   MOV     R0,#OPSTAT
0364 27            679          CLR     A
0365 AD            680          MOV     R5,A    ;SET INVALID KEY
0366 37            681          CPL     A
0367 39            682          OUTL    P1,A    ;SET P1 TO ALL 1'S
0368 9AF0          683          ANL     P2,#0F0H        ;SET P20-P23 TO 0'S
036A 09            684          IN      A,P1
036B 43E0          685          ORL     A,#0E0H ;SET A5-A7 TO 1'S
036D 37            686          CPL     A
036E C6A0          687          JZ      KYXIT   ;NO KEY PRESSED
0370 F0            688          MOV     A,@R0
0371 969A          689          JNZ     KYTIM   ;DEBOUNCE FLAG ON
0373 8ACF          690          ORL     P2,#0FH ;OUTPUT 4 HIGHS
0375 BCFE          691          MOV     R4,#0FEH        ;BIT ENABLE
0377 BDFB          692          MOV     R5,#(-5)        ;START VALUE
0379 BE04          693          MOV     R6,#4   ;LOOP COUNT
037B 2305          694 KYLP:    MOV     A,#5
037D 6D            695          ADD     A,R5
037E AD            696          MOV     R5,A    ;SAVE TOTAL COUNT (INCREMENT BY 5
037F 0A            697          IN      A,P2
0380 5C            698          ANL     A,R4
0381 3A            699          OUTL    P2,A    ;LOWER 1 BIT OF P2
0382 FC            700          MOV     A,R4
0383 E7            701          RL      A       ;SHIFT BIT ENABLE POSITION
0384 AC            702          MOV     R4,A
0385 09            703          IN      A,P1
0386 43E0          704          ORL     A,#0E0H
0388 37            705          CPL     A
0389 9690          706          JNZ     KYVLD   ;COLUMN DETECTED
038B EE7B          707          DJNZ    R6,KYLP
038D AD            708          MOV     R5,A    ;INVALID OR NO KEY PRESSED
038E 64A0          709          JMP     KYXIT
0390 1D            710 KYVLD:   INC     R5
0391 67            711          RRC     A
0392 E690          712          JNC     KYVLD   ;LOOP UNTIL ROW DETECTED
0394 FD            713          MOV     A,R5
0395 07            714          DEC     A       ;GET TABLE INDEX VALUE
0396 A3            715          MOVP    A,@A    ;GET VALUE FROM TABLE
0397 AD            716          MOV     R5,A    ;SAVE VALUE FROM TABLE
0398 B001          717          MOV     @R0,#1  ;SET DEBOUNCE FLAG
039A F8            718 KYTIM:   MOV     A,R0    ;SAVE R0
039B B829          719          MOV     R0,#DBCNT
039D B0ED          720          MOV     @R0,#(-19)      ;SET DEBOUNCE COUNT
039F A8            721          MOV     R0,A    ;RESTORE R0
03A0 B82B          722 KYXIT:   MOV     R0,#FLSTAT
03A2 FD            723          MOV     A,R5    ;KEY EQUIVALENT NUMBER
03A3 C6D3          724          JZ      DLYTM   ;INVALID KEY
03A5 F0            725          MOV     A,@R0
03A6 37            726          CPL     A
03A7 12BC          727          JB0     CMTST   ;NOT FIRE ALARM
03A9 9ACF          728          ANL     P2,#0CFH        ;TURN OFF AUDIO
03AB 8A40          729          ORL     P2,#LOVOL       ;LOWER VOLUME
03AD 37            730          CPL     A
03AE 53FE          731          ANL     A,#NOT(FIRFLG)  ;RESET FIRE FLAG
03B0 A0            732          MOV     @R0,A
03B1 18            733          INC     R0
03B2 F0            734          MOV     A,@R0
03B3 53DF          735          ANL     A,#NOT(AL2MD)   ;TURN OFF ALARM 2
03B5 A0            736          MOV     @R0,A
03B6 122A          737          JB0     JRCVR   ;STANDBY MODE
03B8 D22A          738          JB6     JRCVR   ;ALARM 1 ACTIVE
```

```
03BA 847C          739          JMP    ARM
03BC 52C2          740 CMTST:   JB2    KYTST   ;NOT CONTINUE MODE
03BE B82F          741          MOV    R0,#CMJMP
03C0 F0            742          MOV    A,@R0
03C1 B3            743          JMPP   @A
03C2 B82C          744 KYTST:   MOV    R0,#MDSTAT      ;TEST FOR VALID OPERATION
03C4 F0            745          MOV    A,@R0
03C5 37            746          CPL    A
03C6 122C          747          JB0    RESET   ;NOT STANDBY
03C8 F0            748          MOV    A,@R0
03C9 F22C          749          JB7    RESET   ;ARM MODE
03CB FD            750          MOV    A,R5
03CC 03F5          751          ADD    A,#(-11)        ;KEYS 0-9
03CE E62A          752          JNC    JRCVR
03D0 032E          753          ADD    A,#(LOW JOFF)
03D2 B3            754          JMPP   @A
03D3 F0            755 DLYTM:   MOV    A,@R0   ;FLSTAT
03D4 5360          756          ANL    A,#(DLY1FL OR DLY2FL)
03D6 962A          757          JNZ    JRCVR   ;1 OR BOTH DELAY FLAGS ARE SET
03D8 18            758          INC    R0
03D9 F0            759          MOV    A,@R0
03DA 53E1          760          ANL    A,#(ARMMD OR AL1MD OR AL2MD OR STBYMD)
03DC 962A          761          JNZ    JRCVR   ;NOT ARM OR STANDBY AND NO ALARMS
03DE F0            762          MOV    A,@R0
03DF 37            763          CPL    A
03E0 322A          764          JB1    JRCVR   ;NOT DELAY MODE
03E2 B82D          765          MOV    R0,#TMSTAT
03E4 F0            766          MOV    A,@R0
03E5 37            767          CPL    A
03E6 D22A          768          JB6    JRCVR   ;NOT 5 SEC
03E8 37            769          CPL    A
03E9 53BF          770          ANL    A,#NOT(SEC5D1)  ;RESET 5 SEC FLAG
03EB A0            771          MOV    @R0,A
03EC B83D          772          MOV    R0,#DLYCNT
03EE F0            773          MOV    A,@R0
03EF 07            774          DEC    A
03F0 A0            775          MOV    @R0,A   ;DECREMENT DELAY COUNTER
03F1 962A          776          JNZ    JRCVR   ;NO TIMEOUT
03F3 847C          777          JMP    ARM     ;TIMED OUT
                   778 ;
0400               779          ORG    400H
                   780 ;
0400 B82E          781 BATTST:  MOV    R0,#OPSTAT
0402 B000          782          MOV    @R0,#0  ;CLEAR DEBOUNCE FLAG
0404 B82C          783          MOV    R0,#MDSTAT
0406 08            784          INS    A,BUS
0407 37            785          CPL    A
0408 F20F          786          JB7    BTFAIL  ;BATTERY FAIL
040A F0            787          MOV    A,@R0
040B 53F6          788          ANL    A,#NOT(BATFLT)*
040D 8424          789          JMP    BTOUT
040F B842          790 BTFAIL:  MOV    R0,#TKSTAT
0411 F0            791          MOV    A,@R0
0412 961F          792          JNZ    BTJMP   ;NOT FIRST TIME
0414 35            793          DIS    TCNTI
0415 B00F          794          MOV    @R0,#15
0417 B826          795          MOV    R0,#TIM7
0419 B000          796          MOV    @R0,#0
041B 18            797          INC    R0
041C B0FF          798          MOV    @R0,#-1
041E 25            799          EN     TCNTI   ;INITIALIZE TIMER
041F B82C          800 BTJMP:   MOV    R0,#MDSTAT
0421 F0            801          MOV    A,@R0
```

* ;CLEAR BATTERY FAIL - DON'T STORE

```
0422 4304        802          ORL    A,#BATFLT ; SET BATTERY FAIL - DON'T STORE
0424 6452        803 BTOUT:   JMP    TIKTST ; ROUTINE TO OUTPUT TICK IF NECESSAR
                 804 ;
0426 AB          805 LSTOR:   MOV    R3,A     ;OUTPUT ROUTINE
0427 BF07        806          MOV    R7,#7    ;ADDRESS & LOOP COUNT
0429 FB          807 LMPLP:   MOV    A,R3
042A E7          808          RL     A
042B AB          809          MOV    R3,A     ;ROTATE & RESAVE INPUT
042C 5308        810          ANL    A,#8     ;LOOK AT BIT 3
042E 4F          811          ORL    A,R7     ;AND IN ADDRESS (7 THRU 0)
042F 43F0        812          ORL    A,#0F0H  ;SET MSH
0431 39          813          OUTL   P1,A     ;OUTPUT DATA ON P1
0432 23FF        814          MOV    A,#0FFH
0434 8A0F        815          ORL    P2,#0FH  ;OUTPUT 4 HIGHS ON P2
0436 9F          816          ANLD   P7,A     ;WRITE DATA TO MEMORY
0437 FF          817          MOV    A,R7
0438 07          818          DEC    A
0439 AF          819          MOV    R7,A     ;DECREMENT ADDRESS
043A 37          820          CPL    A
043B 9629        821          JNZ    LMPLP    ;NOT = -1
043D 37          822          CPL    A
043E 39          823          OUTL   P1,A     ;SET P1 TO ONES
043F 83          824          RET
                 825 ;
                 826 ;
0440 B830        827 NEWCD:   MOV    R0,#CMCNT
0442 B92B        828          MOV    R1,#FLSTAT
0444 F1          829          MOV    A,@R1
0445 724D        830          JB3    NCCNT3   ;BAD BIT FLAG
0447 2339        831          MOV    A,#COD1
0449 60          832          ADD    A,@R0
044A A9          833          MOV    R1,A     ;ADDRESS OF CODE BIT
044B FD          834          MOV    A,R5     ;KEY VALUE FROM TABLE
044C A1          835          MOV    @R1,A    ;SAVE IN COD(N)
044D 10          836 NCCNT3:  INC    @R0
044E F0          837          MOV    A,@R0
044F 03FD        838          ADD    A,#(-3)
0451 9669        839          JNZ    NCXIT    ;NOT FINISHED
0453 B92B        840          MOV    R1,#FLSTAT
0455 F1          841          MOV    A,@R1
0456 725A        842          JB3    NCRST    ;BAD BIT FLAG
0458 94AF        843          CALL   BLINK    ;ACKNOWLEDGE OK
045A B82B        844 NCRST:   MOV    R0,#FLSTAT
045C F0          845          MOV    A,@R0
045D 53E3        846          ANL    A,#NOT(SCFLG OR BBTFLG OR CMFLG) ;RESET FLAC
045F A0          847          MOV    @R0,A
0460 18          848          INC    R0
0461 F0          849          MOV    A,@R0
0462 53BF        850          ANL    A,#NOT(AL1MD); TORN OFF "SET CODE MODE LAMPS
0464 A0          851          MOV    @R0,A
0465 B830        852          MOV    R0,#CMCNT
0467 27          853          CLR    A
0468 A0          854          MOV    @R0,A    ;CLEAR COUNTER
0469 2400        855 NCXIT:   JMP    MLRCV
                 856 ;
046B B92B        857 SETCOD:  MOV    R1,#FLSTAT
046D F1          858          MOV    A,@R1
046E 4314        859          ORL    A,#(SCFLG OR CMFLG) ;SET "SET CODE FLAGS"
0470 A1          860          MOV    @R1,A
0471 19          861          INC    R1
0472 F1          862          MOV    A,@R1
0473 4340        863          ORL    A,#AL1MD ;SET "SET CODE MODE LAMPS"
0475 A1          864          MOV    @R1,A
0476 B92F        865          MOV    R1,#CMJMP
0478 B13A        866          MOV    @R1,#(LOW JOFF)+12 ;SET JUMP TO RESETX
```

```
047A 2400        867          JMP     MLRCV
                 868 ;
047C B82C        869 ARM:     MOV     R0,#MDSTAT
047E F0          870          MOV     A,@R0
047F 5316        871          ANL     A,#(BATFLT OR SILMD OR DLYMD)
0481 4380        872          ORL     A,#ARMMD
0483 A0          873          MOV     @R0,A   ;SET IMMEDIATE ARM
0484 2400        874          JMP     MLRCV
                 875 ;
0486 B92B        876 SETDEL:  MOV     R1,#FLSTAT
0488 F1          877          MOV     A,@R1
0489 4304        878          ORL     A,#CMFLG
048B A1          879          MOV     @R1,A   ;SET CONTINUE MODE FLAG
048C 19          880          INC     R1
048D F1          881          MOV     A,@R1
048E 4302        882          ORL     A,#DLYMD        ;SET "SET DELAY LAMPS"
0490 A1          883          MOV     @R1,A
0491 B92F        884          MOV     R1,#CMJMP
0493 B12F        885          MOV     @R1,#(LOW JOFF)+01 ; SET JUMP TO "SET DELAY"
0495 FD          886          MOV     A,R5
0496 C6AD        887          JZ      SDXIT   ;INVALID KEY
0498 03F6        888          ADD     A,#(-10)
049A F6AD        889          JC      SDXIT   ;KEY NOT 1-9
049C B93C        890          MOV     R1,#DLYNO
049E FD          891          MOV     A,R5
049F A1          892          MOV     @R1,A   ;SAVE NEW DELAY #
04A0 B92B        893          MOV     R1,#FLSTAT
04A2 F1          894          MOV     A,@R1
04A3 53E3        895          ANL     A,#NOT(SCFLG OR BSTFLG OR CMFLG)
04A5 A1          896          MOV     @R1,A   ;RESET "SET DELAY FLAGS"
04A6 19          897          INC     R1
04A7 F1          898          MOV     A,@R1
04A8 53FD        899          ANL     A,#NOT(DLYMD)   ;RESET "SET DELAY" LAMPS
04AA A1          900          MOV     @R1,A
04AB 94AF        901          CALL    BLINK   ;ACKNOWLEDGE OK
04AD 2400        902 SDXIT:   JMP     MLRCV
                 903 ;
04AF 23F3        904 BLINK:   MOV     A,#0F3H
04B1 9426        905          CALL    LSTOR   ;OUTPUT ALL LAMPS ON
04B3 BAC8        906          MOV     R2,#200
04B5 16B9        907 BLTLP:   JTF     BLCNT
04B7 04B5        908          JMP     BLTLP
04B9 EAB5        909 BLCNT:   DJNZ    R2,BLTLP        ;LOOP FOR 1/2 SECOND
04BB 83          910          RET
                 911 ;
04BC B92C        912 ARMWD:   MOV     R1,#MDSTAT
04BE F1          913          MOV     A,@R1
04BF 5314        914          ANL     A,#(BATFLT OR SILMD)
04C1 4302        915          ORL     A,#DLYMD
04C3 A1          916          MOV     @R1,A   ;SET DELAY MODE ON
04C4 B93C        917          MOV     R1,#DLYNO
04C6 F1          918          MOV     A,@R1
04C7 19          919          INC     R1
04C8 A1          920          MOV     @R1,A   ;INIT DELAY COUNTER
04C9 B924        921          MOV     R1,#TIMS
04CB 35          922          DIS     TCNTI
04CC B179        923          MOV     @R1,#121
04CE 19          924          INC     R1
04CF B10F        925          MOV     @R1,#15
04D1 B92D        926          MOV     R1,#TMSTAT      ;INIT TIMERS
04D3 F1          927          MOV     A,@R1
04D4 53B3        928          ANL     A,#NOT(SEC301 OR SEC302 OR SEC501)
04D6 A1          929          MOV     @R1,A   ;CLEAR TIME FLAGS
04D7 25          930          EN      TCNTI
04D8 2400        931          JMP     MLRCV
```

```
                 932 ;
0500             933          ORG     500H
                 934 ;
0500 B92C        935 SILENT:  MOV     R1,#MDSTAT
0502 F1          936          MOV     A,@R1
0503 D310        937          XRL     A,#SILMD        ;CHANGE SILENT STATUS
0505 A1          938          MOV     @R1,A
0506 2400        939          JMP     MLRCV
                 940 ;
0508 B82E        941 LMPTST:  MOV     R0,#OPSTAT
050A B000        942          MOV     @R0,#0  ;CLEAR DEBOUNCE FLAG
050C 23F3        943          MOV     A,#0F3H
050E 9426        944          CALL    LSTOR   ;TURN ON ALL LAMPS
0510 643B        945          JMP     KYBD
                 946 ;
0512 B92C        947 RBFLMP:  MOV     R1,#MDSTAT
0514 F1          948          MOV     A,@R1
0515 53FB        949          ANL     A,#NOT(BATFLT)  ;RESET BATTERY FAIL FLAG
0517 A1          950          MOV     @R1,A
0518 2400        951          JMP     MLRCV
                 952 ;
051A B82C        953 TEST:    MOV     R0,#MDSTAT
051C F0          954          MOV     A,@R0
051D 4380        955          ORL     A,#ARMMD; SET ARM MODE WITH STANDBY
051F A0          956          MOV     @R0,A
0520 2400        957          JMP     MLRCV
                 958 ;
0522 27          959 REINIT:  CLR     A
0523 B92B        960          MOV     R1,#FLSTAT
0525 A1          961          MOV     @R1,A   ;CLEAR FLAGS
0526 19          962          INC     R1
0527 F1          963          MOV     A,@R1
0528 5314        964          ANL     A,#(BATFLT OR SILMD) *
052A 4301        965          ORL     A,#STBYMD       ;SET STANDBY
052C A1          966          MOV     @R1,A
052D 27          967          CLR     A
052E B930        968          MOV     R1,#CMCNT
0530 A1          969          MOV     @R1,A
0531 9ACF        970          ANL     P2,#NOT(AUDEN OR HIFREQ) ; TURN OFF AUDIO
0533 8A40        971          ORL     P2,#LOVOL       ;SET LOW VOLUME
0535 94AF        972          CALL    BLINK   ;ACKNOWLEDGE OK
0537 2400        973          JMP     MLRCV
0539 B92F        974 RESETX:  MOV     R1,#CMJMP
053B B13A        975          MOV     @R1,#(LOW JOFF)+12 ; SET CONTINUE TO RESETX
053D B830        976          MOV     R0,#CMCNT
053F 2339        977          MOV     A,#COD1
0541 60          978          ADD     A,@R0
0542 A9          979          MOV     R1,A    ;SAVE CODE 1 ADDRESS +0/1/2
0543 10          980          INC     @R0     ;INCREMENT COUNT
0544 F1          981          MOV     A,@R1   ;OLD CODE
0545 37          982          CPL     A
0546 6D          983          ADD     A,R5
0547 37          984          CPL     A       ;SUBTRACT NEW FROM OLD
0548 B92B        985          MOV     R1,#FLSTAT
054A 9661        986          JNZ     NONVAL  ;IF THEY DON'T MATCH
054C F1          987          MOV     A,@R1
054D 4304        988          ORL     A,#CMFLG
054F A1          989          MOV     @R1,A   ;SET CONTINUE FLAG IF MATCH
0550 F0          990 RSCNT3:  MOV     A,@R0
0551 03FD        991          ADD     A,#(-3)
0553 965F        992          JNZ     RSXIT   ;NOT 3 YET
0555 F1          993          MOV     A,@R1
```

*;RESET ALL BUT BATTERY & SILENT

```
0556 37          994          CPL    A
0557 9222        995          JB4    REINIT  ;SET CODE FLAG NOT SET
0559 B92F        996 RS2SC:   MOV    R1,#CMJMP
055B B138        997          MOV    @R1,#(LOW JOFF)+10 [1]
055D 27          998 RSZCNT:  CLR    A
055E A0          999          MOV    @R0,A   ;CLEAR COUNTER
055F 2400        1000 RSXIT:  JMP    MLRCV
0561 F1          1001 NONVAL: MOV    A,@R1
0562 9276        1002         JB4    RSBDBT  ;IF SET CODE MODE
0564 B839        1003         MOV    R0,#COD1
0566 F0          1004         MOV    A,@R0
0567 B830        1005         MOV    R0,#CMCNT
0569 DD          1006         XRL    A,R5
056A 9670        1007         JNZ    RSCONT  ;NOT FIRST CODE
056C B001        1008         MOV    @R0,#1  ;SET COUNTER TO 1
056E 2400        1009         JMP    MLRCV
0570 F1          1010 RSCONT: MOV    A,@R1
0571 53FB        1011         ANL    A,#NOT(CMFLG)   ;RESET CONTINUE FLAG
0573 A1          1012         MOV    @R1,A
0574 A45D        1013         JMP    RSZCNT
0576 F1          1014 RSBDBT: MOV    A,@R1
0577 4308        1015         ORL    A,#BBTFLG       ;SET BAD BIT FLAG
0579 A1          1016         MOV    @R1,A
057A A450        1017         JMP    RSCNT3
                 1018 ;
                 1019 ;
057C B92A        1020 RALLMP: MOV    R1,#ALSTAT
057E B100        1021         MOV    @R1,#0  ;RESET ALARM MEMORIES
0580 2400        1022         JMP    MLRCV
0582 9ACF        1023 XEQ:    ANL    P2,#NOT(AUDEN OR HIFREQ) [2]
0584 B820        1024         MOV    R0,#TIM1
0586 BA0A        1025         MOV    R2,#10
0588 2301        1026         MOV    A,#1
058A A0          1027 XEQ1:   MOV    @R0,A
058B 18          1028         INC    R0
058C EA8A        1029         DJNZ   R2,XEQ1 ;INITIALIZE 1ST 10 REGISTERS TO 1
058E 27          1030         CLR    A
058F BA0F        1031         MOV    R2,#15
0591 A0          1032 XEQ2:   MOV    @R0,A
0592 18          1033         INC    R0
0593 EA91        1034         DJNZ   R2,XEQ2 ;INITIALIZE NEXT 15 REGISTERS TO
0595 BA03        1035         MOV    R2,#3
0597 17          1036 XEQ3:   INC    A
0598 A0          1037         MOV    @R0,A
0599 18          1038         INC    R0
059A EA97        1039         DJNZ   R2,XEQ3 ;SET CODE TO 1,2,3
059C E7          1040         RL     A
059D A0          1041         MOV    @R0,A   ;SET DELAY TO 30 SEC
059E 27          1042         CLR    A
059F BA14        1043         MOV    R2,#20
05A1 18          1044 XEQ4:   INC    R0
05A2 A0          1045         MOV    @R0,A
05A3 EAA1        1046         DJNZ   R2,XEQ4 ;SET NEXT 20 REGISTERS TO 0
05A5 B92C        1047         MOV    R1,#MDSTAT
05A7 B101        1048         MOV    @R1,#1  ;SET MODE TO STANDBY
05A9 B83E        1049         MOV    R0,#MANMEM
05AB C9          1050         IN     A,P1
05AC A0          1051         MOV    @R0,A   ;INPUT & SAVE MANUAL SET/RESET
05AD 99BF        1052         ANL    P1,#NOT(INTRES)
05AF 8940        1053         ORL    P1,#INTRES      ;CLEAR INTERRUPT LATCH
```

[1] ;SET CONTINUE TO "SET CODE"

[2] ;TURN OFF AUDIO CHIRP

```
05B1 55        1054        STRT    T       ;START TIMER
05B2 25        1055        EN      TCNTI   ;ENABLE TIMER INTERRUPT
05B3 05        1056        EN      I       ;ENABLE DATA INTERRUPT
05B4 2400      1057        JMP     MLRCV
               1058 $EJECT

 LOC OBJ        LINE        SOURCE STATEMENT
                1059         END
USER SYMBOLS
AAOFF  02A3   ADDCH1 01EA   AL12CK 016C   ALIMD  0040   AL2MD  0020   ALARM  0187
ALCLMD 0008   ALRMM1 0040   ALRMM2 0020   ALSTAT 002A   ARM    047C   ARMMD  0030
ARMWD  04BC   ATEST  021F   ATEST1 029A   ATICK  0080   ATIME  0251   ATIMR  023C
ATJ1   01A0   AUDCTL 0265   AUDEN  0010   AXIT   02B4   BATFLT 0004   BATTST 0400
BBTFLG 0008   BITCNT 001E   BLCNT  0469   BLINK  04AF   BLTLP  04B5   BTFAIL 040F
BTJMP  041F   BTOUT  0424   CH2TST 01C3   CMCNT  0030   CMFLG  0004   CMJMP  002F
CMTST  03BC   COD1   0039   COD2   003A   COD3   003B   DATAI  001E   DATASR 001D
DATINT 000A   DATRET 002B   DBCNT  0029   DBFLG  0001   DCDLP  0118   DCDZRO 0129
DECODE 010F   DJ1    01A2   DJ2    01CC   DJ3    018D   DJ4    0199   DLY1FL 0040
DLY2FL 0020   DLYCHK 01B2   DLYCK  01F7   DLYCNT 003D   DLYMD  0002   DLYNO  003C
DLYOFF 0203   DLYTM  03D3   ENLK   00B2   FALSE  0000   FDFLG  0002   FIRALM 020D
FIRCH  027C   FIRE   014D   FIRFLG 0001   FIXERR 0000   FLSTAT 002B   HIFREQ 0020
INTRES 0040   JDLYOF 0197   JOFF   032E   JRCVR  032A   KEYBD  034F   KYBD   033B
KYBD1  0362   KYLP   037B   KYTB   0300   KYTIM  039A   KYTST  03C2   KYVLD  0390
KYXIT  03A0   LKSTAT 003F   LKTMST 0096   LMPLP  0429   LMPTST 0508   LOUT   02D3
LOVOL  0040   LSTAT  02C5   LSTOR  0426   MANMEM 003E   MDSTAT 002C   MIN10M 0080
MLRCV  0100   MSG0   0031   MSG1   0032   MSG2   0033   MSG3   0034   MSG4   0035
MSG5   0036   MSG6   0037   MSG7   0038   NCCNT3 044D   NCRST  045A   NCXIT  0469
NEW1   0349   NEWCD  0440   NOFIRE 0159   NONVAL 0561   NOTICK 0360   NULCNT 0028
NULXIT 0084   OFFTIM 028B   OPSTAT 002E   ORTEST 02CE   PREVLK 009F   RALLMP 057C
REFLMP 0512   RBIT10 00D1   RBIT7  00DE   RCVFLG 0080   RCVST1 00C2   RCVSTB 00BD
REINIT 0522   RESET  032C   RESETX 0539   RLVON  020A   RS2SC  0559   RSBDBT 0576
RSCNT3 0550   RSCONT 0570   RSXIT  055F   RSZCNT 055D   RXIT1  0120   RXIT2  0139
RXIT3  0173   RXIT4  017F   SCFLG  001C   SDXIT  04AD   SEC3D1 0004   SEC3D2 0008
SEC3M1 0001   SEC3M2 0002   SEC5D1 0040   SEC5M1 0010   SEC5M2 0020   SET2AL 01DD
SETCH  0165   SETCOD 046B   SETDEL 0486   SILENT 0500   SILMD  0010   SONHI  0278
SONLO  0274   SONOFF 0289   STBYMD 0001   TALCHK 0229   TALON  0233   TEST   051A
TIKTST 0352   TIM1   0020   TIM10  0041   TIM2   0021   TIM3   0022   TIM4   0023
TIM5   0024   TIM6   0025   TIM7   0026   TIM8   0027   TIM9   0040   TIMCHK 01F1
TIMER  0030   TIMER1 0037   TIMOUT 0291   TINTST 0259   TKSTAT 0042   TMSTAT 002D
TRUE   0001   TSTFLG 0002   TXIT1  0057   TXIT2  006F   TXIT3  007B   TXIT4  008D
TXIT5  0086   WINIT  00D9   WINIT1 00D8   XD1    0018   XD2    0019   XD3    001A
XD4    001B   XD5    001C   XD6    001F   XEQ    0582   XEQ1   058A   XEQ2   0591
XEQ3   0597   XEQ4   05A1

ASSEMBLY COMPLETE,  NO ERRORS
```

Once given the above disclosure, many other features, modifications and improvements will become apparent to the skilled artisan. Such other modifications, features and improvements are, therefore, considered a part of this invention, the scope of which is to be determined by the following claims.

I claim:

1. A transmitter-receiver burglar alarm system comprising a battery powered transmitter unit including a transmitter of radio waves, means for sensing a low battery voltage at said transmitter unit, said transmitter unit having means for transmitting a low battery voltage signal, and means for transmitting a channel selecting code bit, means connected to the transmitter unit for preventing said transmitter unit from making further transmissions after transmitting said low battery voltage signal, a base station including a receiver for receiving radio waves transmitted by said transmitter unit, said base station having means responsive to transmission of said channel selecting code bit to provide a first audible sound and responsive to the absence of said channel selecting code bit to produce a second audible sound, said base station further including at will actuatable means responsive to receipt of said channel selecting code bit for producing a third audible sound, and means responsive to said low battery voltage signal for producing a fourth audible sound.

2. The apparatus according to claim 1 wherein said transmitter unit further comprises means for sensing alarm conditions including said low battery condition, means for supplying voltage to said alarm condition sensing circuits, and means for energizing said transmitter only in response to the sensing of an alarm condition.

3. A transmitter-receiver burglar alarm system according to claim 1 or claim 2 further comprising:

a base unit including a receiver, said base unit including means responsive to receipt of said low battery voltage signal to provide a first distinctive indication of an indefinite period that at least one of a plurality of transmitter units has a low battery voltage.

4. The apparatus according to claim 1 or claim 2 further comprising:

a base unit including a receiver, said transmitter unit including means for selectively transmitting one of a plurality of selection codes, said base unit including means responsive to said one channel selection code to provide corresponding signals in response to each different channel selection code.

5. The apparatus according to claim 1 further comprising a base unit including means for receiving transmissions from said transmitter, an audible alarm, said base unit having, at will, selectable means for delaying response to receipt of a code before sounding said alarm, said transmitting unit having, at will, selectable means for transmitting a delay response code, said base unit producing a delayed response only upon receipt of a delay response code when said means for delaying response has been set to produce a delayed response.

6. The apparatus according to claim 1 further comprising means defining a first channel and a second channel, each said transmitter including means for transmitting an at will selectable code indicative of one of a first channel signal and a second channel signal, a base unit including means for producing different responses to receipt of said first channel code and said second channel code.

7. The apparatus according to claim 6 wherein said base unit further comprises an audible alarm, a volume control for said audible alarm, means for establishing a different mode of operation on said second channel only, said means for establishing producing full volume on said audible alarm in response to a signal selecting said second channel.

8. The apparatus according to claim 1 wherein said base station further comprises means responsive to receipt of a transmission for providing a first visual display indicating which of said channels has been selected by said transmitting unit, means for silencing said audible signal, and means responsive to said means for silencing for providing a second visual display indicative of the selected channel.

9. The apparatus according to claim 8 wherein said means for silencing comprises means for establishing a first code in response to which said audible signal is terminated, circuit means responsive to introduction of said first code into said base station to terminate said audible sound, means for changing the code to which said circuit means is responsive, and means responsive to a specified electrical condition for reestablishing response of said circuit means to said first code.

10. The apparatus according to claim 1 further comprising a first audible alarm generator, a second audible alarm generator, said base station providing means for testing said system, and means for disabling said second audible alarm generator during system test.

11. The apparatus according to claim 1 further comprising a first audible alarm generator, a second audible alarm generator, said base station providing means for testing for low voltage of batteries associated with said base station, and means for activating only said first audible alarm generator upon detection of a low battery voltage condition.

12. The apparatus according to claim 1 or claim 2 further comprising means responsive to an audible smoke detector signal for transmitting an alarm signal, and means responsive to said alarm signal for generating a further audible alarm signal.

13. A transmitter receiver coded alarm system comprising:

a base station including (a) a receiver for receiving digital signals, (b) an alarm means, (c) two channels, (d) delay means for providing a delay in producing an alarm signal to a set signal input to said delay means, and (e) means responsive to an electrical power fault condition to produce an indication thereof, a plurality of transmitters for transmitting digial signals to said receiver means upon detection of predetermined conditions, first means for programming said receiver to receive digital signals having a selected n-bit identification code, where N is a positive integer, said transmitters including means for incorporating the selected n-bit identification code on signals transmitted to said receiver, and for selectively transmitting a delay response code and for transmitting a channel selection code, one of said channels of said base station being responsive to receipt of a said n-bit identification code to activate said alarm, the other of said channels delaying activation of said alarm upon receipt of said n-bit identification code and said delay response code, when said delay response means has been set to produce a delayed response, each said transmitter having a separate battery and means for generating a low power signal, a shut-down switch at each transmitter, means at each transmitter for producing a low power code signal in response to said low power signal, said low power signal being communicated (a) first to said receiver and (b) thereafter to said shut down switch whereby to deactivate said transmitter, means for communicating an alarm disarm code to the base station, means for inhibiting the alarm means in response to the communication of the alarm disarm code, the inhibiting means being selectively interposed between the communicating means and the alarm means, means for defining the alarm disarm code as a first disarm code, means, associated with the defining means for storing the first disarm code, means, associated with the defining means, for automatically reverting the alarm disarm code back to the first alarm disarm code in response to the indication of an electrical power fault condition, the reverting means being coupled to the first disarm code storing means.

14. A system according to claim 13 wherein each transmitter comprises means for providing digital signals in frequency shift key (FSK) format.

15. A system according to claim 13 wherein the first means and the second means each comprise means for changing the selected n-bit code.

16. A system according to claim 15 wherein the n-bit code changing means are manually operable switches.

17. A system according to claim 13 wherein the reverting means comprises:

means for causing said disarm code to automatically revert to said first code in response to an interruption of power to the base station.

18. A system according to claim 13 further comprising:

a principal power source connectable to the alarm means and a secondary portable power source, the secondary portable power source being connected to power the alarm means when the principal power source is disconnected from the alarm means.

19. A system according to claim 13 wherein the alarm means comprises:

an internal audio device at the base station unit, an external audio device remote from but receiving appropriate alarm signal input from the base station unit, and selectable means for disabling the internal device.

20. A system according to claim 19 wherein one of the transmitters comprises an actuatable panic device which, when actuated, transmits a signal to the receiver means that produces an immediate alarm signal.

21. A system according to claim 13 wherein each such transmitter provides a plurality of discrete signals having the selected identification code contained therein in response to the occurrence of at least one of the predetermined conditions, such discrete signals being repeated periodically.

22. A system according to claim 13 further comprising:

alarm means for producing an alarm signal responsive to receipt at the receiver means of a signal including the selected identification code of the receiver means, and test means, at each transmitter, for generating a transmission only when a transmitter under test is active, the alarm means providing an alarm signal responsive to the receipt by the receiver means of a transmission from an active transmitter having the selected identification code.

23. An alarm system comprising:

a base station having means responsive to an electrical power fault condition for producing an indication thereof, means for communicating an alarm disarm code to the base station, means for inhibiting the alarm means in response to the communication of the alarm disarm code, the inhibiting means being selectively interposed between the communicating means and the alarm means, means for defining the alarm disarm initially as a first disarm code, means, associated with the defining means, for storing the first disarm code, means, associated with the defining means, for changing the defined alarm disarm code, at will, from one alarm disarm code to another alarm disarm code, means, associated with the defining means, for reverting the alarm disarm code back to the first alarm disarm code in response to the indication of an electrical power fault condition, the reverting means being coupled to the first disarm code storing means.

24. A system according to claim 23 wherein the reverting means comprises:

means for causing said disarm code to automatically revert to said first alarm disarm code in response to an interruption of power to the base station.

* * * * *